US012544612B2

(12) United States Patent
Parker et al.

(10) Patent No.: US 12,544,612 B2
(45) Date of Patent: Feb. 10, 2026

(54) ENHANCING CONCENTRIC LOAD EXPERIENCED BY USER

(71) Applicant: Tonal Systems, Inc., San Francisco, CA (US)

(72) Inventors: Colin Russell Parker, San Francisco, CA (US); Troy Taylor, Park City, UT (US); Nihal Murthy, Oakland, CA (US)

(73) Assignee: Tonal Systems, Inc., San Francisco, CA (US)

( * ) Notice: Subject to any disclaimer, the term of this patent is extended or adjusted under 35 U.S.C. 154(b) by 44 days.

(21) Appl. No.: 18/660,085

(22) Filed: May 9, 2024

(65) Prior Publication Data

US 2025/0345647 A1 Nov. 13, 2025

(51) Int. Cl.
*A63B 21/005* (2006.01)
*A63B 24/00* (2006.01)

(52) U.S. Cl.
CPC ..... *A63B 21/0058* (2013.01); *A63B 24/0087* (2013.01); *A63B 2220/54* (2013.01)

(58) Field of Classification Search
CPC ..... A63B 21/0058; A63B 24/0087; A63B 2220/54
See application file for complete search history.

(56) References Cited

U.S. PATENT DOCUMENTS 4,930,770 A * 6/1990 Baker ..... A63B 21/0058 482/141
5,020,794 A * 6/1991 Englehardt ..... A63B 24/00 73/379.06
5,569,121 A * 10/1996 Sellier ..... A63B 21/0059 482/9
6,244,988 B1 6/2001 Delman
6,368,251 B1 * 4/2002 Casler ..... A63B 23/03525 482/901
11,123,609 B2 9/2021 Rubin
11,285,351 B2 3/2022 Orady
12,239,871 B1 3/2025 Ilfrey
2007/0281828 A1 12/2007 Rice
2012/0058859 A1 3/2012 Elsom-Cook
2012/0231930 A1 * 9/2012 Hsieh ..... A63B 23/03533 482/6
2014/0038777 A1 2/2014 Bird
2015/0151161 A1 6/2015 Anderton
2016/0354638 A1 * 12/2016 Carr ..... A63B 21/4043
2018/0021616 A1 1/2018 Orady
2019/0031284 A1 1/2019 Fuchs
2019/0070448 A1 * 3/2019 Jeremic ..... A63B 21/0059
2019/0344123 A1 11/2019 Rubin
2020/0298062 A1 * 9/2020 Gilstrom ..... H02J 7/34
(Continued)

FOREIGN PATENT DOCUMENTS

GB 2587320 3/2021
WO 2023235600 12/2023
WO 2024044213 2/2024

*Primary Examiner* — Sundhara M Ganesan

(74) *Attorney, Agent, or Firm* — Van Pelt, Yi & James LLP

(57) ABSTRACT

During at least a portion of a user exercise movement in which an actuator velocity of an actuator is in an outward direction, an amount of torque that is requestable from a motor is increased based at least in part on the actuator velocity. The motor provides resistance to the actuator. The actuator is coupled to the motor.

13 Claims, 11 Drawing Sheets

(56) References Cited

U.S. PATENT DOCUMENTS

| | | | | |
|---|---|---|---|---|
| 2020/0398139 | A1* | 12/2020 | Harley | A63B 69/38 |
| 2021/0394023 | A1 | 12/2021 | Belson | |
| 2022/0134186 | A1 | 5/2022 | Zoffoli | |
| 2022/0184446 | A1 | 6/2022 | Mino | |
| 2022/0339481 | A1 | 10/2022 | Peal | |
| 2023/0009699 | A1 | 1/2023 | Ferlito | |
| 2023/0089946 | A1 | 3/2023 | Orady | |
| 2023/0115911 | A1 | 4/2023 | Keiser | |
| 2023/0226407 | A1 | 7/2023 | Belson | |
| 2023/0264062 | A1 | 8/2023 | Parker | |
| 2023/0310940 | A1* | 10/2023 | Lee | A63B 21/0058 482/4 |
| 2023/0330476 | A1 | 10/2023 | Ashby | |
| 2024/0009522 | A1 | 1/2024 | Huber | |
| 2024/0033571 | A1* | 2/2024 | James | A63B 71/0054 |
| 2024/0058652 | A1 | 2/2024 | Bird | |
| 2024/0108939 | A1 | 4/2024 | Perry | |
| 2024/0123292 | A1* | 4/2024 | Gregory | A63B 21/153 |
| 2024/0293279 | A1* | 9/2024 | Srinivasan | A61H 1/0288 |
| 2024/0316391 | A1* | 9/2024 | Pezeshkian | H02K 1/12 |
| 2025/0001257 | A1 | 1/2025 | Ben | |
| 2025/0022317 | A1 | 1/2025 | Kitamura | |
| 2025/0090893 | A1* | 3/2025 | Simenthi | A63B 21/4035 |

* cited by examiner

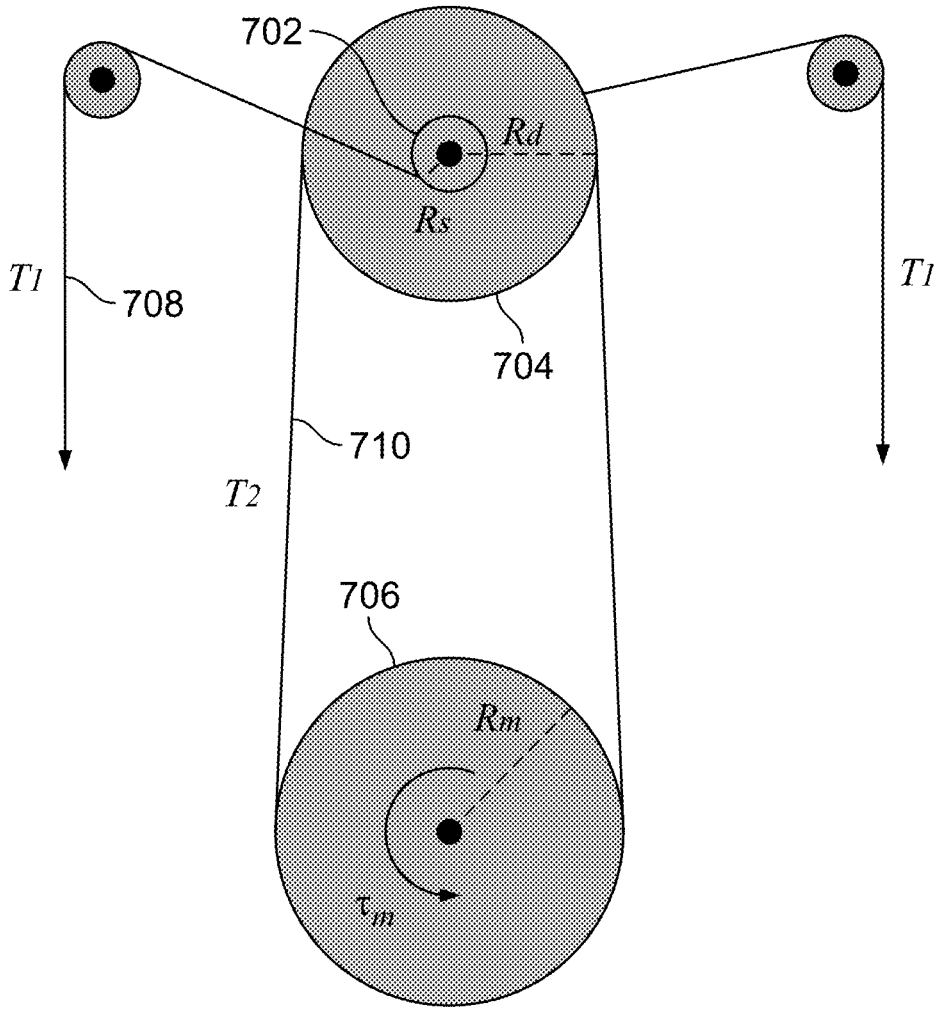
FIG. 7A
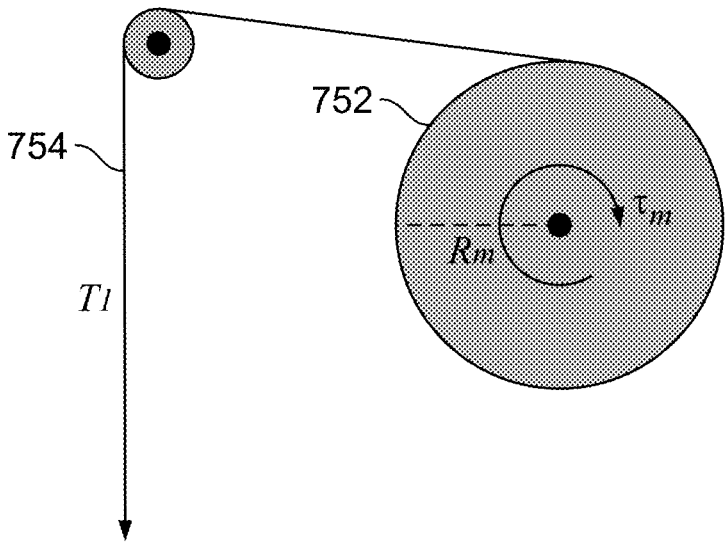
FIG. 7B(1)

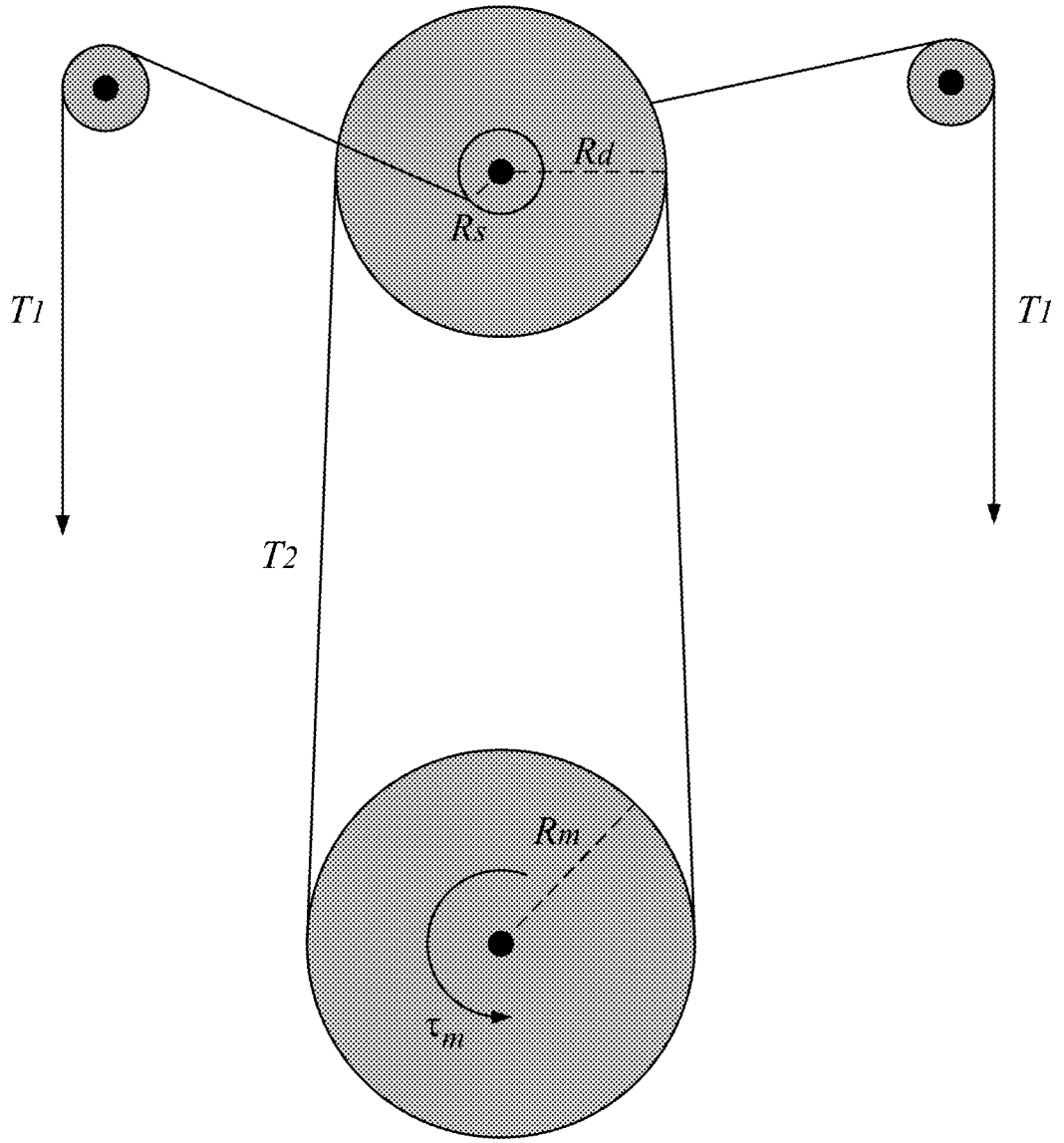
FIG. 7B(2)

ENHANCING CONCENTRIC LOAD EXPERIENCED BY USER

BACKGROUND OF THE INVENTION

Strength training, also referred to as resistance training or weight lifting, is an important part of any exercise routine. It promotes the building of muscle, the burning of fat, and improvement of a number of metabolic factors including insulin sensitivity and lipid levels. Aerobic training is also important as it promotes endurance and cardiovascular/respiratory health. As referred to herein, exercise training is strength training, aerobic training, or any combination that uses an exercise device.

A digital exercise device is an improvement over a traditional exercise device as it provides a more safe, effective, and engaging experience. Improving a digital exercise device experience to be more efficient and/or provide greater diversity of motion experiences is useful.

BRIEF DESCRIPTION OF THE DRAWINGS

Various embodiments of the invention are disclosed in the following detailed description and the accompanying drawings.

FIGS. 7A, 7B(1), and 7B(2) are diagrams illustrating an example of two different exercise devices with different drivetrain designs.

DETAILED DESCRIPTION

Figure 1A:
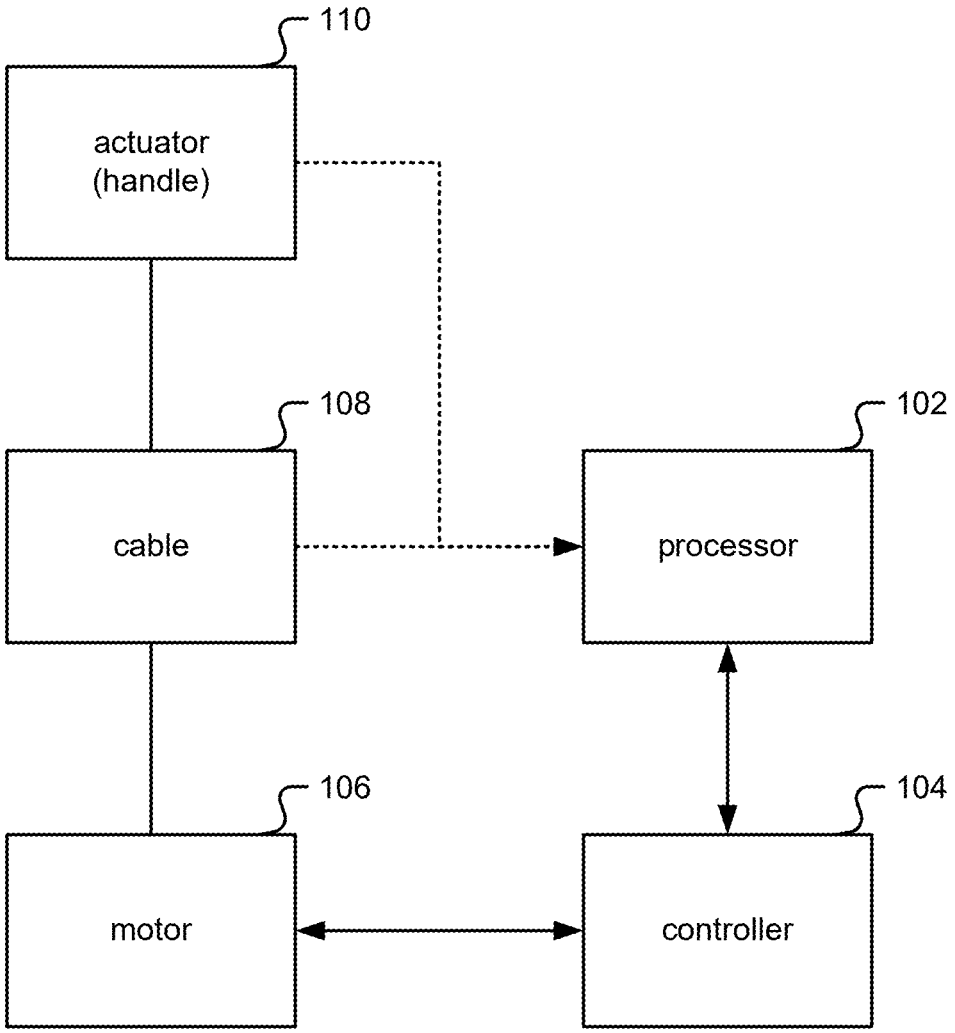
FIG. 1A is a block diagram illustrating an embodiment of an exercise machine capable of digital exercise training.

The invention can be implemented in numerous ways, including as a process; an apparatus; a system; a composition of matter; a computer program product embodied on a computer readable storage medium; and/or a processor, such as a processor configured to execute instructions stored on and/or provided by a memory coupled to the processor. In this specification, these implementations, or any other form that the invention may take, may be referred to as techniques. In general, the order of the steps of disclosed processes may be altered within the scope of the invention. Unless stated otherwise, a component such as a processor or a memory described as being configured to perform a task may be implemented as a general component that is temporarily configured to perform the task at a given time or a specific component that is manufactured to perform the task. As used herein, the term 'processor' refers to one or more devices, circuits, and/or processing cores configured to process data, such as computer program instructions.

A detailed description of one or more embodiments of the invention is provided below along with accompanying figures that illustrate the principles of the invention. The invention is described in connection with such embodiments, but the invention is not limited to any embodiment. The scope of the invention is limited only by the claims and the invention encompasses numerous alternatives, modifications and equivalents. Numerous specific details are set forth in the following description in order to provide a thorough understanding of the invention. These details are provided for the purpose of example and the invention may be practiced according to the claims without some or all of these specific details. For the purpose of clarity, technical material that is known in the technical fields related to the invention has not been described in detail so that the invention is not unnecessarily obscured.

Enabling greater maximum weight in a concentric phase of an exercise movement for an exercise device is disclosed.

Adjusting inertia that a user experiences via dynamic torque control for an exercise device is disclosed.

A digital exercise device is referred to herein as an exercise device wherein electricity is used to generate tension/resistance, for example using an electromagnetic field. In one embodiment, the electromagnetic field is provided via an electronic motor, such as a three-phase permanent magnet synchronous motor (PMSM). An advantage of a digital exercise device over a traditional exercise device is that the digital exercise device may be smaller and lighter than a traditional exercise device such as a weight stack. A digital exercise device may also be more versatile by way of electronic and/or digital control. Electronic control enables the use of a processor/controller to apply tension. By contrast, a traditional exercise device require tension to be changed physically/manually; in the case of a weight stack, a pin has to be moved by a user from one metal plate to another.

A digital exercise device is also versatile by way of using dynamic resistance referred to herein as the ability to change tension/resistance nearly instantaneously and without physical/manual adjustment. When tension is coupled to position of a user against their range of motion, the digital exercise device may apply arbitrary applied tension curves, both in terms of position and in terms of phase of an exercise movement: concentric, eccentric, isometric, and/or aerobic. Furthermore, the shape of these curves may be changed continuously and/or in response to events; the tension may be controlled continuously as a function of a number of internal and external variables including position and phase, and the resulting applied tension curve may be pre-determined and/or adjusted continuously in real time.

FIG. 1A is a block diagram illustrating an embodiment of an exercise machine capable of digital exercise training. The exercise machine may include the following, including optional components as not all these elements are necessary:

- a controller circuit (104), for example a torque controller (104), which may include a processor, inverter, pulse-width-modulator, and/or a Variable Frequency Drive (VFD);
- a motor (106), for example a three-phase AC driven by the controller circuit;
- a spool with a cable (108) wrapped around the spool and coupled to the spool. On the other end of the cable an actuator/handle (110) is coupled in order for a user to grip and pull on. The spool is coupled to the motor (106) either directly or via a shaft/belt/chain/gear mechanism. Throughout this specification, a spool may be also referred to as a "hub";

a processor (102), for example a filter (102), to digitally control the controller circuit (104) based on receiving information from the cable (108) and/or actuator (110);

optionally (not shown in FIG. 1) a gearbox between the motor and spool. Gearboxes multiply torque and/or friction, divide speed, and/or split power to multiple spools. Without changing the fundamentals of digital exercise training, a number of combinations of motor and gearbox may be used to achieve the same end result. A cable-pulley system may be used in place of a gearbox, a differential gearbox may be used as a gearbox, and/or a dual motor may be used in place of a gearbox;

one or more of the following sensors (not shown in FIG. 1): a position encoder; a sensor to measure position of the actuator (110). Examples of position encoders include a hall effect shaft encoder, grey-code encoder on the motor/spool/cable (108), an accelerometer in the actuator/handle (110), optical sensors, position measurement sensors/methods built directly into the motor (106), and/or optical encoders. In one embodiment, an optical encoder is used with an encoding pattern that uses phase to determine direction associated with the low resolution encoder. Other options that measure back-EMF (back electromagnetic force) from the motor (106) in order to calculate position also exist;

one or more sensors to measure voltage and/or current being consumed by the motor (106), for example to provide inputs to calculate electrical power;

a user tension sensor; a torque/tension/strain sensor and/or gauge to measure how much tension/force is being applied to the actuator (110) by the user. In one embodiment, a tension sensor is built into the cable (108). Alternatively, a strain gauge is built into the motor mount holding the motor (106). As the user pulls on the actuator (110), this translates into strain on the motor mount which is measured using a strain gauge in a Wheatstone bridge configuration. In another embodiment, the cable (108) is guided through a pulley coupled to a load cell. In another embodiment, a belt coupling the motor (106) and cable spool or gearbox (108) is guided through a pulley coupled to a load cell. In another embodiment, the resistance generated by the motor (106) is characterized based on the voltage, current, or frequency input to the motor.

In one embodiment, a three-phase AC motor (106) is used with the following:

a controller circuit (104)/torque controller (104) combined with processor (102) comprising:

a processor that runs software instructions;

three pulse width modulators (PWMs), each with two channels, modulated at 20 kHz;

six transistors of a three leg inverter coupled to the three PWMs;

optionally, two or three ADCs (Analog to Digital Converters) monitoring current through each inverter; and/or optionally, two or three ADCs monitoring inverter phase voltage;

the three-phase AC motor (106), which may include a synchronous-type and/or asynchronous-type permanent magnet motor, such that:

the motor (106) may be in an "out-runner configuration" as described below;

the motor (106) may have a maximum torque output of at least 60 Nm and a maximum speed of at least 300 RPMs;

optionally, with an encoder or other method to measure motor position;

a cable (108) wrapped around the body of the motor (106) such that the entire motor (106) rotates, so the body of the motor is being used as a cable spool in one case. Thus, the motor (106) is directly coupled to a cable (108) spool. In one embodiment, the motor (106) is coupled to a cable spool via a shaft, gearbox, belt, and/or chain, allowing the diameter of the motor (106) and the diameter of the spool to be independent, as well as introducing a stage to add a set-up or step-down ratio if desired. Alternatively, the motor (106) is coupled to two spools with an apparatus in between to split or share the power between those two spools. Such an apparatus could include a differential gearbox, or a pulley configuration; and/or an actuator (110) such as a handle, a bar, a strap, or other accessory connected directly, indirectly, or via a connector such as a carabiner to the cable (108).

In some embodiments, the controller (102)/(104) is programmed to drive the motor in a direction such that it draws the cable (108) towards the motor (106). The user pulls on the actuator (110) coupled to cable (108) against the direction of pull of the motor (106).

One purpose of this setup is to provide an experience to a user similar to using a traditional cable-based strength training machine or traditional cable-based aerobic machine like a rower/ergometer, where the cable is attached to a weight stack being acted on by gravity or flywheel. Rather than the user resisting the pull of gravity or flywheel resistance, they are instead resisting the pull of the motor (106).

Taking the example of a strength training device without limitation, note that with a traditional cable-based strength training machine, a weight stack may be moving in two directions: away from the ground or towards the ground. When a user pulls with sufficient tension, the weight stack rises, and as that user reduces tension, gravity overpowers the user and the weight stack returns to the ground.

By contrast in a digital strength trainer, there is no actual weight stack. The notion of the weight stack is one modeled by the system. The physical embodiment is an actuator (110) coupled to a cable (108) coupled to a motor (106). A "weight moving" is instead translated into a motor rotating. As the circumference of the spool is known and how fast it is rotating is known, the linear motion of the cable may be calculated to provide an equivalency to the linear motion of a weight stack. Each rotation of the spool equals a linear motion of one circumference or $2\pi r$ for radius r. Likewise, torque of the motor (106) may be converted into linear force by multiplying it by radius r.

If the virtual/perceived "weight stack" is moving away from the ground, motor (106) rotates in one direction. If the "weight stack" is moving towards the ground, motor (106) rotates in the opposite direction. Note that the motor (106) is pulling towards the cable (108) onto the spool. If the cable (108) is unspooling, it is because a user has overpowered the motor (106). Thus, note a distinction between the direction the motor (106) is pulling, and the direction the motor (106) is actually turning.

If the controller (102)/(104) is set to drive the motor (106) with, for example, a constant torque in the direction that spools the cable, corresponding to the same direction as a weight stack being pulled towards the ground, then this translates to a specific force/tension on the cable (108) and actuator (110). Calling this force "Target Tension", this force may be calculated as a function of torque multiplied by the radius of the spool that the cable (108) is wrapped around, accounting for any additional stages such as gear boxes or belts that may affect the relationship between cable tension and torque. If a user pulls on the actuator (110) with more force than the Target Tension, then that user overcomes the motor (106) and the cable (108) unspools moving towards that user, being the virtual equivalent of the weight stack rising. However, if that user applies less tension than the Target Tension, then the motor (106) overcomes the user and the cable (108) spools onto and moves towards the motor (106), being the virtual equivalent of the weight stack returning.

AC Motor. While many motors exist that run in thousands of revolutions per second, an application such as a digital exercise device has different requirements and is by comparison a low speed, high torque type application suitable for an AC motor.

In one embodiment, a requirement of such a motor (106) is that a cable (108) wrapped around a spool of a given diameter, directly coupled to a motor (106), behaves like a 200 lbs weight stack, with the user pulling the cable at a maximum linear speed of 62 inches per second. A number of motor parameters may be calculated based on the diameter of the spool.

| User Requirements | | | | | | |
|---|---|---|---|---|---|---|
| Target Weight | 200 lbs | | | | | |
| Target Speed | 62 inches/sec = 1.5748 meters/sec | | | | | |
| Requirements by Spool Size | | | | | | |
| Diameter (inches) | 3 | 5 | 6 | 7 | 8 | 9 |
| RPM | 394.7159 | 236.82954 | 197.35795 | 169.1639572 | 148.0184625 | 131.5719667 |
| Torque (Nm) | 67.79 | 112.9833333 | 135.58 | 158.1766667 | 180.7733333 | 203.37 |
| Circumference (inches) | 9.4245 | 15.7075 | 18.849 | 21.9905 | 25.132 | 28.2735 |

Thus, a motor with 67.79 Nm of force and a top speed of 395 RPM, coupled to a spool with a 3 inch diameter meets these requirements. 395 RPM is slower than most motors available, and 68 Nm is more torque than most motors on the market as well.

Hub motors are three-phase permanent magnet AC direct drive motors in an "out-runner" configuration: throughout this specification out-runner means that the permanent magnets are placed outside the stator rather than inside, as opposed to many motors which have a permanent magnet rotor placed on the inside of the stator as they are designed more for speed than for torque. Out-runners have the magnets on the outside, allowing for a larger magnet and pole count and are designed for torque over speed. Another way to describe an out-runner configuration is when the shaft is fixed and the body of the motor rotates.

Hub motors also tend to be "pancake style". As described herein, pancake motors are higher in diameter and lower in depth than most motors. Pancake style motors are advantageous for a wall mount, subfloor mount, and/or floor mount application where maintaining a low depth is desirable, such as a piece of fitness equipment to be mounted in a consumer's home or in an exercise facility/area. As described herein, a pancake motor is a motor that has a diameter higher than twice its depth. As described herein, a pancake motor is between 15 and 60 centimeters in diameter, for example 22 centimeters in diameter, with a depth between 6 and 15 centimeters, for example a depth of 6.7 centimeters.

Motors may also be "direct drive", meaning that the motor does not incorporate or require a gear box stage. Many motors are inherently high speed low torque but incorporate an internal gearbox to gear down the motor to a lower speed with higher torque and may be called gear motors. Direct drive motors may be explicitly called as such to indicate that they are not gear motors.

If a motor does not exactly meet the requirements illustrated in the table above, the ratio between speed and torque may be adjusted by using gears or belts to adjust. A motor coupled to a 9" sprocket, coupled via a belt to a spool coupled to a 4.5" sprocket doubles the speed and halves the torque of the motor. Alternatively, a 2:1 gear ratio may be used to accomplish the same thing. Likewise, the diameter of the spool may be adjusted to accomplish the same.

Alternatively, a motor with 100× the speed and 100th the torque may also be used with a 100:1 gearbox. As such a gearbox also multiplies the friction and/or motor inertia by 100×, torque control schemes become challenging to design for exercise applications. Friction may then dominate what a user experiences. In other applications friction may be present, but is low enough that it is compensated for, but when it becomes dominant, it is difficult to control for. For these reasons, direct control of motor speed and/or motor position as with AC motors is more appropriate for exercise devices.

Figure 1B:
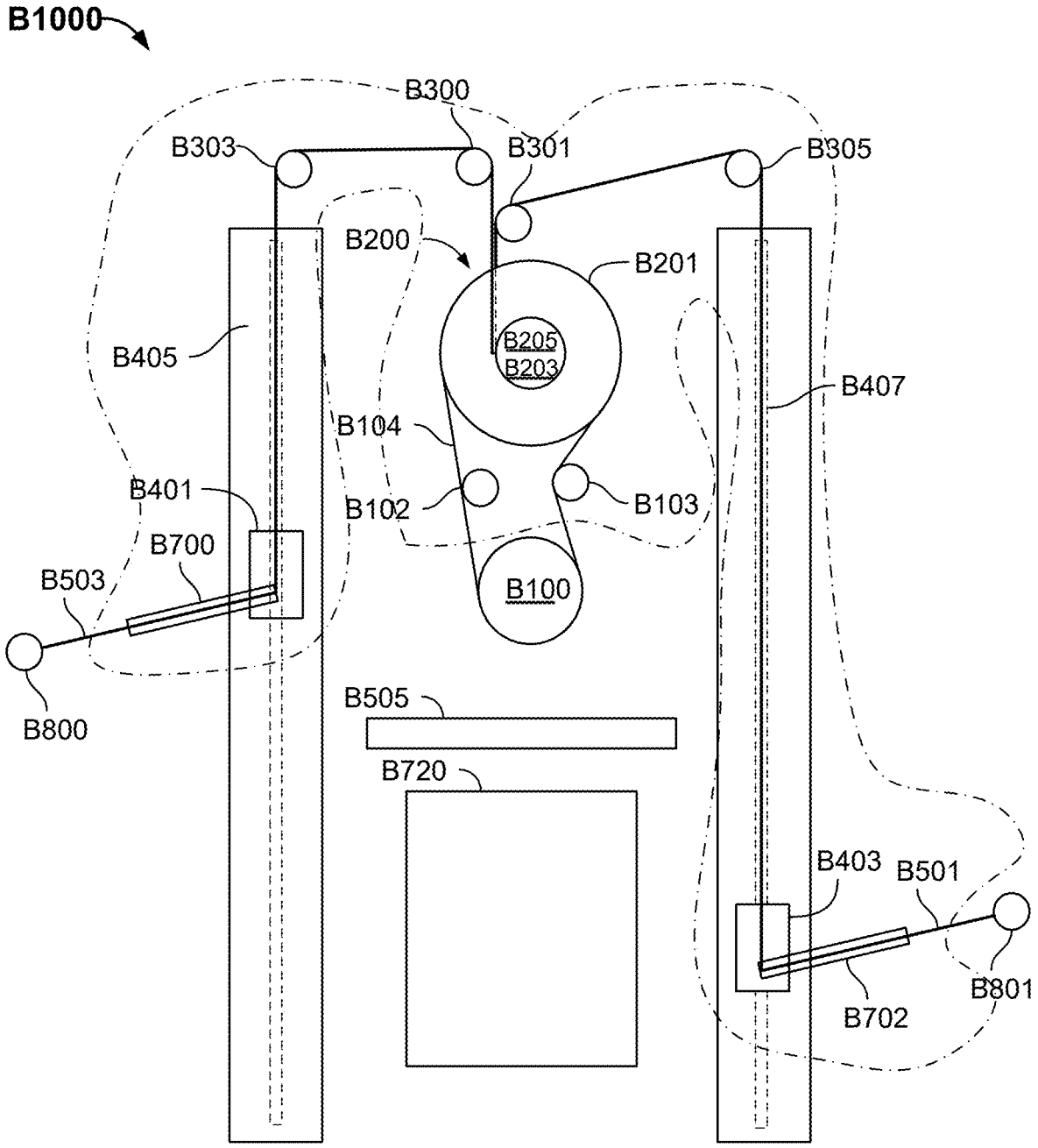
FIG. 1B illustrates a front view of one embodiment of an exercise machine.

FIG. 1B illustrates a front view of one embodiment of an exercise machine. In some embodiments, exercise machine (B1000) of FIG. 1B is an example or alternate view of the exercise machine of FIG. 1A. In this example, exercise machine (B1000) includes a pancake motor (B100), a torque controller coupled to the pancake motor, and a high resolution encoder coupled to the pancake motor (B102). As used herein, a "high resolution" encoder refers to an encoder with an electrical angle resolution of 30 degrees or less. In this example, two cables (B503) and (B501) are coupled respectively to actuators (B800) and (B801) on one end of the cables. The two cables (B503) and (B501) are coupled directly or indirectly on the opposite end to the motor (B100). While an induction motor may be used for motor (B100), a PMSM motor may also be used for its cost, size, weight, and performance. In some embodiments, a high resolution encoder assists the system to determine the position of the PMSM motor to control torque. While an example involving a single motor is shown, the exercise machine may include other configurations of motors, such as dual motors, with each cable coupled to a respective motor.

Sliders (B401) and (B403) may be respectively used to guide the cable (B503) and (B501) respectively along rails (B405) and (B407). The exercise machine in FIG. 1B translates motor torque into cable tension. As a user pulls on actuators (B800) and/or (B801), the machine creates/maintains tension on cable (B503) and/or (B501). The actuators (B800), (B801) and/or cables (B503), (B501) may be actuated in tandem or independently of one another.

In one embodiment, electronics bay (B720) is included and has the necessary electronics to drive the system. In one embodiment, fan tray (B505) is included and has fans that cool the electronics bay (B720) and/or motor (B100).

Drivetrain. As shown in FIG. 1B, the drivetrain is marked by a dash-dot line. As referred to herein, a drivetrain comprises the components that deliver mechanical power between motor (B100) and actuator(s) (B800)/(B801). The drivetrain also comprises the motor itself (B100), the controller (104) in FIG. 1A, and electrical components such as an electrical shunt to dissipate power as heat, and the electrical power supply, typically a wall supply of 120V/240V (not shown in FIG. 1A or 1B). Motor (B100) is coupled by belt (B104) to an optional optical rotary encoder (B102), an optional belt tensioner (B103), and a spool assembly (B200). In one embodiment, an encoder is located in the motor (B100) and element (B102) is not necessary. In one embodiment, the belt tensioner (B103) is not necessary. In one embodiment, motor (B100) is an out-runner, such that the shaft is fixed and the motor body rotates around that shaft. In one embodiment, motor (B100) generates torque in the counter-clockwise direction facing the machine, as in the example in FIG. 1B. Motor (B100) has teeth compatible with the belt integrated into the body of the motor along the outer circumference. Referencing an orientation viewing the front of the system, the left side of the belt (B104) is under tension, while the right side of the belt is slack. The belt tensioner (B103) takes up any slack in the belt. An optical rotary encoder (B102) coupled to the tensioned side of the belt (B104) captures all motor movement, with significant accuracy because of the belt tension. In one embodiment, the optical rotary encoder (B102) is a high resolution encoder. In one embodiment, a toothed belt (B104) is used to reduce belt slip. The spools rotate counter-clockwise as they are spooling cable/taking cable in, and clockwise as they are unspooling/releasing cable out.

Spool assembly (B200) comprises a front spool (B203), rear spool (B205), and belt sprocket (B201). The spool assembly (B200) couples the belt (B104) to the belt sprocket (B201), and couples the two cables (B503) and (B501) respectively with spools (B205) and (B203). Each of these components is part of a low profile design. In one embodiment, a dual motor configuration not shown in FIG. 1B is used to drive each cable (B503) and (B501). In the example shown in FIG. 1B, a single motor (B100) is used as a single source of tension, with a plurality of gears configured as a differential are used to allow the two cables/actuators to be operated independently or in tandem. In one embodiment, spools (B205) and (B203) are directly adjacent to sprocket (B201), thereby minimizing the profile of the machine in FIG. 1B.

As shown in FIG. 1B, two arms (B700), (B702), two cables (B503), (B501) and two spools (B205), (B203) are useful for users with two hands, and the principles disclosed without limitation may be extended to three, four, or more arms (B700) for quadrupeds and/or group exercise. In one embodiment, the plurality of cables (B503), (B501) and spools (B205), (B203) are driven by one sprocket (B201), one belt (B104), and one motor (B100), and so the machine (B1000) combines the pairs of devices associated with each user hand into a single device. In other embodiments, each arm is associated with its own motor and spool. In one embodiment, more than one motor (B100) is coupled to a drivetrain for one or more actuators (B800), for example two motors (B100) each coupled via a drivetrain similar to that shown in FIG. 1B to a single actuator (B800).

In one embodiment, motor (B100) provides constant tension on cables (B503) and (B501) despite the fact that each of cables (B503) and (B501) may move at different speeds. For example, some physical exercises may require use of only one cable at a time. For another example, a user may be stronger on one side of their body than another side, causing differential speed of movement between cables (B503) and (B501). In one embodiment, a device combining dual cables (B503) and (B501) for a single belt (B104) and sprocket (B201) retains a low profile, in order to maintain the compact nature of the machine, which can be mounted on a wall.

In one embodiment, pancake style motor(s) (B100), sprocket(s) (B201), and spools (B205, 203) are manufactured and arranged in such a way that they physically fit together within the same space, thereby maximizing functionality while maintaining a low profile.

As shown in FIG. 1B, spools (B205) and (B203) are respectively coupled to cables (B503) and (B501) that are wrapped around the spools. The cables (B503) and (B501) route through the system to actuators (B800) and (B801), respectively.

The cables (B503) and (B501) are respectively positioned in part by the use of "arms" (B700) and (B702). The arms (B700) and (B702) provide a framework for which pulleys and/or pivot points may be positioned. The base of arm (B700) is at arm slider (B401) and the base of arm (B702) is at arm slider (B403).

The cable (B503) for a left arm (B700) is attached at one end to actuator (B800). The cable routes via arm slider (B401) where it engages a pulley as it changes direction, then routes along the axis of rotation of track (B405). At the top of rail/track (B405), fixed to the frame rather than the track, is pulley (B303) that orients the cable in the direction of pulley (B300), that further orients the cable (B503) in the direction of spool (B205), wherein the cable (B503) is wound around spool (B205) and attached to spool (B205) at the other end.

Similarly, the cable (B501) for a right arm (B702) is attached at one end to actuator (B801). The cable (B501) routes via slider (B403) where it engages a pulley as it changes direction, then routes along the axis of rotation of rail/track (B407). At the top of the rail/track (B407), fixed to the frame rather than the track is pulley (B305) that orients the cable in the direction of pulley (B301), that further orients the cable in the direction of spool (B203), wherein the cable (B501) is wound around spool (B203) and attached to spool (B203) at the other end.

One use of pulleys (B300), (B301) is that they permit the respective cables (B503), (B501) to engage respective spools (B205), (B203) "straight on" rather than at an angle, wherein "straight on" references being within the plane perpendicular to the axis of rotation of the given spool. If the given cable were engaged at an angle, that cable may bunch up on one side of the given spool rather than being distributed evenly along the given spool.

In the example shown in FIG. 1B, pulley (B301) is lower than pulley (B300). This demonstrates the flexibility of routing cables. In one embodiment, mounting pulley (B301) leaves clearance for certain design aesthetic elements that make the machine appear to be thinner.

In one embodiment, the exercise machine/appliance passes a load/resistance against the user via one or more lines/cables, to a grip(s) (examples of an actuator) that a user displaces to exercise. A grip may be positioned relative to the user using a load arm and the load path to the user may be steered using pulleys at the load arm ends, as described above. The load arm may be connected to a frame of the exercise machine using a carriage that moves within a track that may be affixed to the main part of the frame. In one embodiment, the frame is firmly attached to a rigid structure such as a wall. In some embodiments, the frame is not mounted directly to the wall. Instead, a wall bracket is first mounted to the wall, and the frame is attached to the wall bracket. In other embodiments, the exercise machine is mounted to the floor. The exercise machine may be mounted to both the floor and the wall for increased stability. In other embodiments, the exercise machine is a freestanding device.

In some embodiments, the exercise machine includes a media controller and/or processor, which monitors/measures user performance (for example, using the one or more sensors described above), and determines loads to be applied to the user's efforts in the resistance unit (e.g., motor described above). Without limitation, the media controller and processor may be separate control units or combined in a single package. In some embodiments, the controller is further coupled to a display/acoustic channel that allows instructional information to be presented to a user and with which the user interacts in a visual manner, which includes communication based on the eye such as video and/or text or icons, and/or an auditory manner, which includes communication based on the ear such as verbal speech, text-to-speech synthesis, and/or music. Collocated with an information channel is a data channel that passes control program information to the processor which generates, for example, exercise loading schedules. In some embodiments, the display is embedded or incorporated into the exercise machine, but need not be (e.g., the display or screen may be separate from the exercise machine, and may be part of a separate device such as a smartphone, tablet, laptop, etc. that may be communicatively coupled (e.g., either in a wired or wireless manner) to the exercise machine). In one embodiment, the display is a large format, surround screen representing a virtual reality/alternate reality environment to the user; a virtual reality and/or alternate reality presentation may also be made using a headset. The display may be oriented in landscape or portrait.

In one embodiment, the appliance media controller provides audio information that is related to the visual information from a program store/repository that may be coupled to external devices or transducers to provide the user with an auditory experience that matches the visual experience. Control instructions that set the operational parameters of the resistance unit for controlling the load or resistance for the user may be embedded with the user information so that the media package includes information usable by the controller to run the machine. In this way a user may choose an exercise regime and may be provided with cues, visual and auditory as appropriate, that allow, for example, the actions of a personal trainer to be emulated. The controller may further emulate the actions of a trainer using an expert system and thus exhibit artificial intelligence. The user may better form a relationship with the emulated coach or trainer, and this relationship may be encouraged by using emotional/mood cues whose effect may be quantified based on performance metrics gleaned from exercise records that track user performance in a feedback loop using, for example, the sensor(s) described above.

Figure 2:
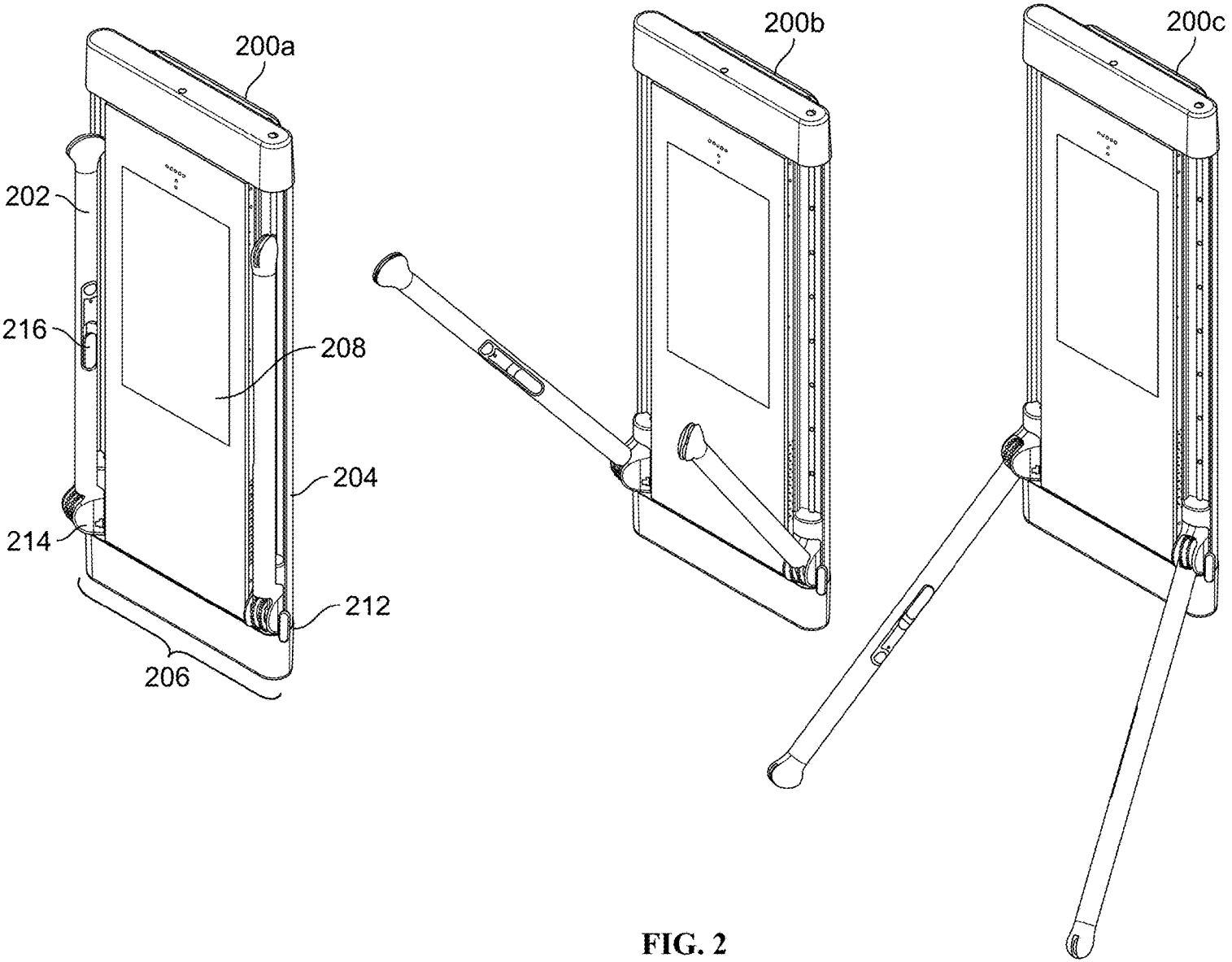
FIG. 2 includes front perspective views of an embodiment of a weight training machine.

Multi-Motor and/or Multi-Spool Based Embodiments. FIG. 2 includes front perspective views of an embodiment of a weight training machine. In one embodiment, the machine of FIG. 2 is the exercise device represented in a block diagram in FIG. 1. In the example of FIG. 2, the exercise device has two arms.

FIG. 2 illustrates an exercise machine with the arms (202) and (204) in a stowed position, where the arms are upright in stowed position (200*a*). FIG. 2 also shows two other positions: first where the exercise machine with the arms vertically pivoted outwards, or angled away from the body of the exercise machine, pointing in an upwards direction (200*b*), and second where the arms are in mid-vertical pivot, pointing in a downwards direction (200*c*).

In this example, control (216) includes controls for unlocking the adjustment of the position of arm (202). In one embodiment, arm (204) also includes a corresponding set of controls. The arms may be independently pivoted to any angle as appropriate.

The exercise machine of FIG. 2 is an embodiment of a digital exercise device/trainer that may use one or two motors as load elements to provide electronic resistance. In the case of a single motor, a differential gearbox may be used. One or two spools may be used with the one or two motors.

In one embodiment, cables travel within the arms, where one end of a cable in a given arm is coupled or otherwise connected to a motor, which may be in the body of the exercise machine. In one embodiment, at the distal end of an arm, away from the body/central console (206) of the trainer, is a handle attached to one end of the cable. A handle is but one example of an actuator that may be used by a user to perform exercise.

In one embodiment, the exercise machine is mounted to a wall. In one embodiment, the exercise machine is floor mounted. The exercise machine may also be a combination of wall/floor mounted. For example, the exercise machine may be mounted to the wall as well as bolted to the floor. The exercise machine may also stand on the floor while being wall mounted. In one embodiment, the exercise machine is freestanding. For example, the exercise machine is attached to a moveable stand, where the stand need not be hard mounted.

In one embodiment, the exercise machine includes one or more of: an antenna, a camera, other optical sensors, depth sensors, infrared sensors, a display, a touch screen, a touch screen controller, an audio input device, a microphone, an audio output device, a speaker, a motor controller, one or more electric motors, one or more spools, one or more cables, and actuators such as handles. The body (206) may include a screen (208).

The motor controller, the handles, and the electric motor are exemplary controllers, exercising components/actuators, and resistive devices/load elements, respectively. In one embodiment, the exercise machine includes multiple motors, for example one per arm. The machine shown in FIG. 2 may have two motors/spools, where an embodiment of a four arm exercise machine (not shown) may have four motors/spools.

In one embodiment, the exercise machine includes a central console (206) for controlling the exercise machine. The console may include a display (208). In one embodiment, the display is a touch screen. In such an example, the display allows instructional information such as virtual training content to be presented to the user and with which a user interacts. In one embodiment, to reduce the interference with an exercise routine that occurs whenever a user interacts with the exercise appliance/machine features or controls, controls are incorporated in the handle. For example, this is an improvement from a case where the user has to release one of the handles in order to use that hand to modify settings selected from options indicated at the display (208) or physical controls located at the control panel (206). Thus, by suitable location of the user controls and application of control context information, the user is able to alter the exercise machine settings with better efficiency to the exercise regime and/or better user safety.

In one embodiment, the exercise machine does not have a display and may be connected to a television or touch-screen monitor via a connection such as HDMI, USB, HDCP, and/or Displayport. In one embodiment, images, video, streaming, audiovisual content, and/or multimedia are transmitted wirelessly to an external display device or other receiver devices such as virtual reality sets, augmented reality sets, set top boxes, and/or game consoles. In one embodiment, data is sent to an application on a mobile device such as a tablet or smartphone, where the application then interprets and renders a user interface for interacting with the exercise machine and/or viewing exercise data measured by the exercise machine for example.

The arms of the exercise machine may have various degrees of freedom (DOFs). In the examples of FIG. 2, the arms of the exercise machine are each capable of moving in at least two directions: 1) horizontal pivot; and 2) vertical pivot (a rotation of the arm relative to the ground). As shown in the example of FIG. 2, the arms pivot vertically about points (212) and (214), which are also referred to herein as the "shoulders" of the exercise machine. In one embodiment, the arms of the exercise machine are each capable of moving in a third direction: translation such as sliding vertically up and down a track.

In one embodiment, the arms of the exercise machine may each have one, two, or three degrees of freedom: 1) vertical pivot, also referred to herein as arm vertical pivoting in the "sagittal" plane, 2) horizontal pivot, to rotate around the shoulder, and/or 3) telescoping of the arm, such as retraction/collapsing of the arm and extension of the arm.

In one embodiment, the arms of the exercise machine are angled outwards from the body (206) of the machine. For example, the arms (202, 204) are not, when extended, perpendicular to the body (206), but rather are slanted horizontally outwards. In one embodiment, angled arms are used in lieu of having an additional degree of freedom, for example, horizontal pivot of the arms, so the arms (202, 204) have two degrees of freedom with vertical pivot and telescoping.

By having the arms on a horizontal pivot angle, when the arms pivot, they start when pointed upward in their most compact/least wide configuration, and widen as they move downwards. This allows the distance between the arms to vary based on the pivot angle. The telescoping, along with the vertical pivot and angled out arms, allows for the arms to provide a large range of motion. The use of angled arms provides various benefits, for example, by simplifying the design of the arms and reducing complexity and cost, such as by removing the need to have mechanisms to allow the arms to pivot horizontally, but still retaining a similar amount of functionality as would be provided by implementing horizontal pivoting of the arms.

Floor-Based Embodiments. In one embodiment, the machine described in FIG. 1 includes ones wherein components such as motors are placed lower, such as near to or on the ground. Floor-based machines described herein have various benefits and/or improvements. For example, a floor-based configuration may be designed to not require arms (202, 204) that have degrees of freedom. The degrees of freedom of arms may be expensive, for example because the arms not only need to pass loads through them, but also be lockable and adjustable. Furthermore, the use of arms may necessitate wall mounting of an exercise machine, which may introduce further installation cost and complexity. Thus, the removal or non-use of such degrees of freedom may allow for less expensive and complex exercise machines while still providing a useful exercise regime.

In one embodiment, floor-based machines are used in conjunction with auxiliary pulleys and/or other cable ends, so that users of the exercise machines and/or weight trainers are configured to pull down on a cable coupled to a cable, for example, retracting cables downward toward the floor. This may mimic the action of weights pulling downwards. In one embodiment, the user stands on the exercise machine. In one embodiment, the user sits on the exercise machine.

One example of a floor-based configuration of a weight machine is a platform or step. A platform configuration of a digital exercise device/trainer has various benefits and/or improvements. For example, it may be portable since it need not be mounted. This allows the exercise machine to be stored away efficiently and/or safely.

Exercise Device Powertrain/Drivetrain. As shown in FIG. 1B, the drivetrain comprises parts (B103), (B104), (B200), (B201), (B203), (B205), (B300)/(B301), (B303)/(B305), (B401)/(B403), and (B501)/(B503). The drivetrain also comprises the motor (B100) The drivetrain does work on the user in order to extract energy from them, wherein the user may be seen as an energy reservoir. The physical relationship that $$\text{Power} = \text{Force} \times \text{Velocity}$$

describes that if the actuator velocity/speed and/or cable velocity/speed increases, power of the motor (B100) and drivetrain increases as well since force, or the simulated weight, is held constant. Similarly, as torque and rotational speed are related to force and velocity, $$\text{Torque} = \frac{1}{2\pi}\frac{\text{Power}}{\text{Rotational Speed}}$$

wherein rotational speed is based upon supply voltage of the motor (B100) and torque generated is related to phase current of the motor (B100).

Two motor constants may be used to describe characteristics of the one or more drivetrain motors (B100). The torque constant or $K_t$ as referred to herein relates the phase current of a motor and generated torque such that $$K_t = \frac{\text{Torque}}{\text{Phase Current}}$$

and the back EMF constant or $K_e$ as referred to herein relates the back EMF generated by the motors (B100) and their rotational speed such that $$K_e = \frac{\text{Back } EMF \text{ Generated}}{\text{Rotational Speed}}$$

For a given motor (B100), gearing allows an exchange of rotational speed for torque, wherein the gearing may come from a gearbox, spool diameter, and/or belt drive reduction, for example. Gearboxes and spools may have user experience and inertia impacts but result in a more efficient system, and geared motors may be smaller for the same torque when compared to a direct drive motor.

The drivetrain operations in at least three modes: a motoring mode wherein electrical power sent from an electrical power supply unit (PSU) to the motor so that the motor does mechanical work on the user; a generator mode wherein the user does mechanical work on the motor and the user's power is dissipated and/or reused within the drivetrain and/or motor; and a shared power mode when the user input power is less than the motor losses, as summarized in Table 1:

Drivetrain Components used in each Mode

| User Direction | Mode | Motor | Controller | Shunt | Power Supply Unit |
|---|---|---|---|---|---|
| Eccentric | Motoring | Yes | Yes | No | Yes |
| Concentric | Generator | Yes | Yes | Yes | No |
| | Shared Power | Yes | Yes | No | Yes |

Figure 3:
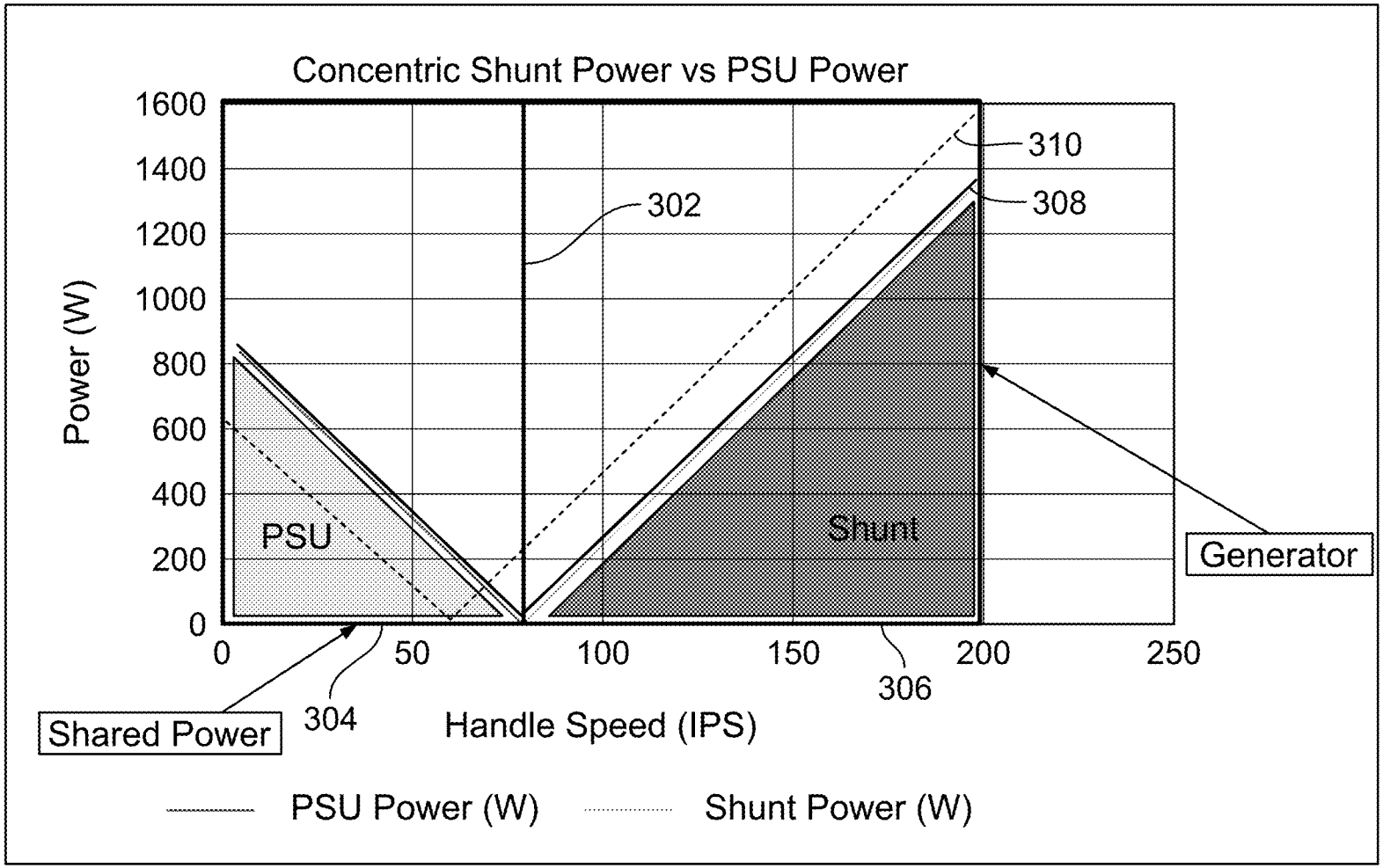
FIG. 3 is a diagram illustrating an example of a low speed and high weight mode for the differential.

FIG. 3 is a diagram illustrating an example of a low speed and high weight mode for the differential. The graph shown in FIG. 3 has along the x-axis the actuator speed in inches per second (IPS) and along the y-axis the system power in watts. For a low speed and/or high weight user exertion there is a transition point (302) between the transition from generator mode and shared power mode during a concentric user direction. The location of the actuator speed transition point (302) depends on the target weight, due in part to motor electrical resistance losses:

$$P_{shunt} = P_{mech_from_user} - (P_{losses_motor} + P_{losses_controller})$$

which as shown in FIG. 3 is around 80 inches per second (302). In FIG. 3 as shown, the shared power mode (304) is shown between 0 and around 80 inches per second with PSU power decreasing from 800 watts to 0 watts, and after the transition point (302) is replaced by the generator mode (306) shown between around 80 inches per second to 200 inches per second with user power increasing from 0 watts to around 1300 watts. As an example of showing how this graph in FIG. 3 changes for a target weight, the PSU power, transition point, and shunt power is shown for a 75 lb target weight with solid line (308), and the PSU power, transition point, and shunt power is shown for a 35 lb target weight with dotted line (310), showing that the transition point will be at a lower actuator speed for a 35 lb target weight, around 60 inches per second.

Figure 4:
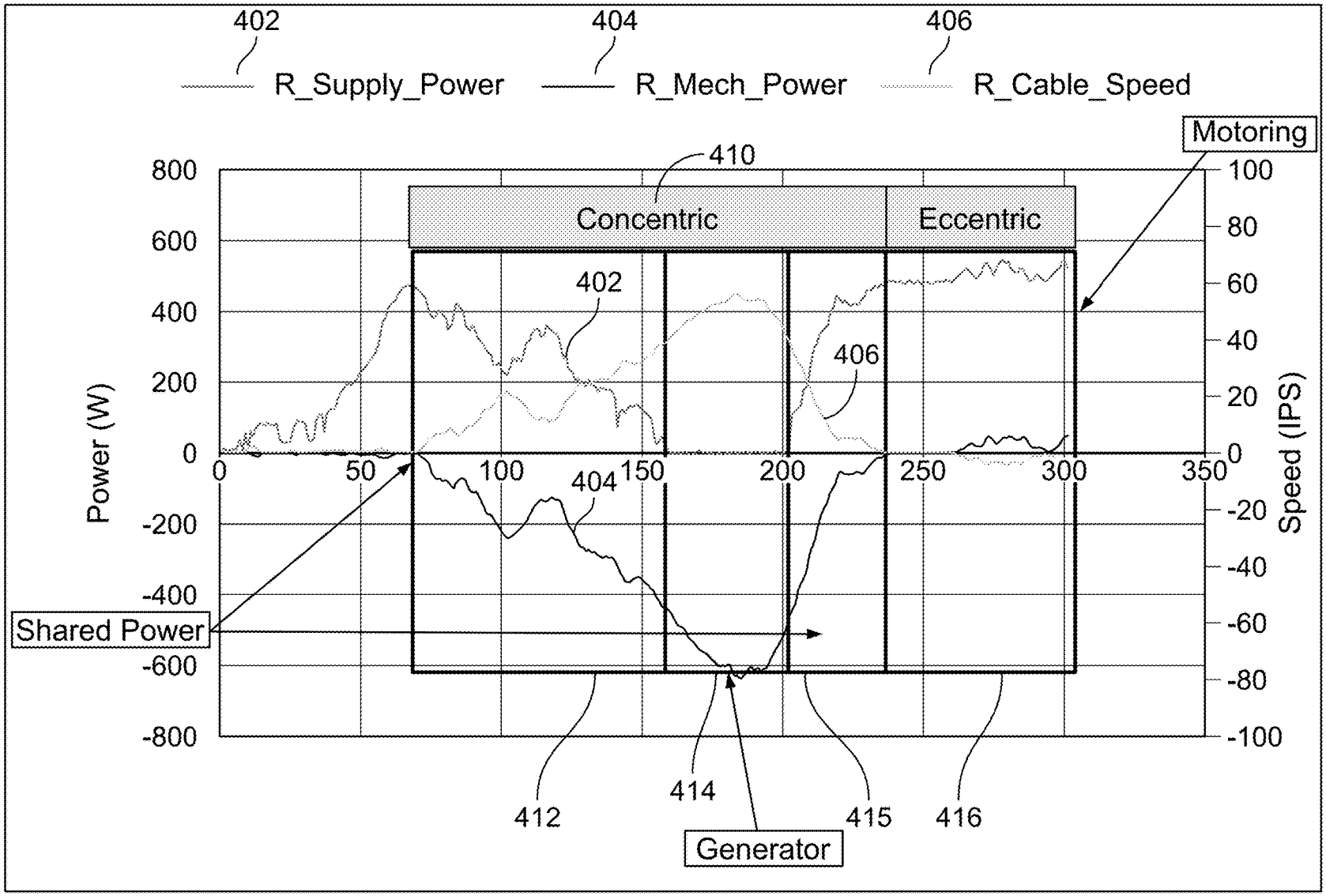
FIG. 4 is a diagram illustrating a power sharing mode example.

FIG. 4 is a diagram illustrating a power sharing mode example. The graph shown in FIG. 4 has along the x-axis a timeline in seconds from 0 to 300 seconds of an exercise movement, and along the primary y-axis for the power in watts, for the PSU supplied power (402) and the user supplied power (404), and along the secondary y-axis for the cable speed (406) in inches per second.

As shown in FIG. 4, a concentric phase (410) of the user exercise movement happens between around 60 seconds and around 230 seconds. The concentric phase (410) starts with a shared power mode (412) between around 60 seconds and 160 seconds where the PSU supplied power (402) decreases from around 500 watts to 0 watts, the user supplied power changes from 0 watts to around-500 watts, and the cable speed increases from 0 inches per second to around 40 inches per second. The concentric phase (410) then traverses a generator mode (414) between 160 seconds and 200 seconds where the PSU supplied power (402) remains at 0 watts, the user supplied power peaks from −500 watts to −600 watts and returns to −500 watts, and the cable speed peaks from 40 inches per second to 60 inches per second and returns to 40 inches per second. The concentric phase (410) returns to a shared power mode (415) between 200 seconds and around 230 seconds where the PSU supplied power (402) increases from 0 watts to around 500 watts, the user supplied power changes from −500 watts to 0 watts, and the cable speed decreases from 40 inches per second to 0 inches per second.

As shown in FIG. 4, the eccentric phase (416) of the user exercise movement happens between around 230 seconds and 300 seconds, comprising the motoring mode (416) where the PSU supplied power (402) increases from 500 watts to around 600 watts, the user supplied power changes between 0 watts to around 40 watts, and the cable speed changes from 0 inches per second to around-5 inches per second.

Note that in FIG. 4 the direction of power flow is referred to herein as positive from the PSU and negative from the user. That is, curve (404) is negative for the concentric phase (410) as the user is injecting power into the motor, and during the eccentric phase curve (416) is positive as the PSU drives the motor. Note that in FIG. 4 the direction of cable speed is referred to herein as positive in an outward direction, that is the cable is spooling outward from the motor, and cable speed is negative in an inward direction, that is the cable is spooling inward towards the motor.

Figure 5A:
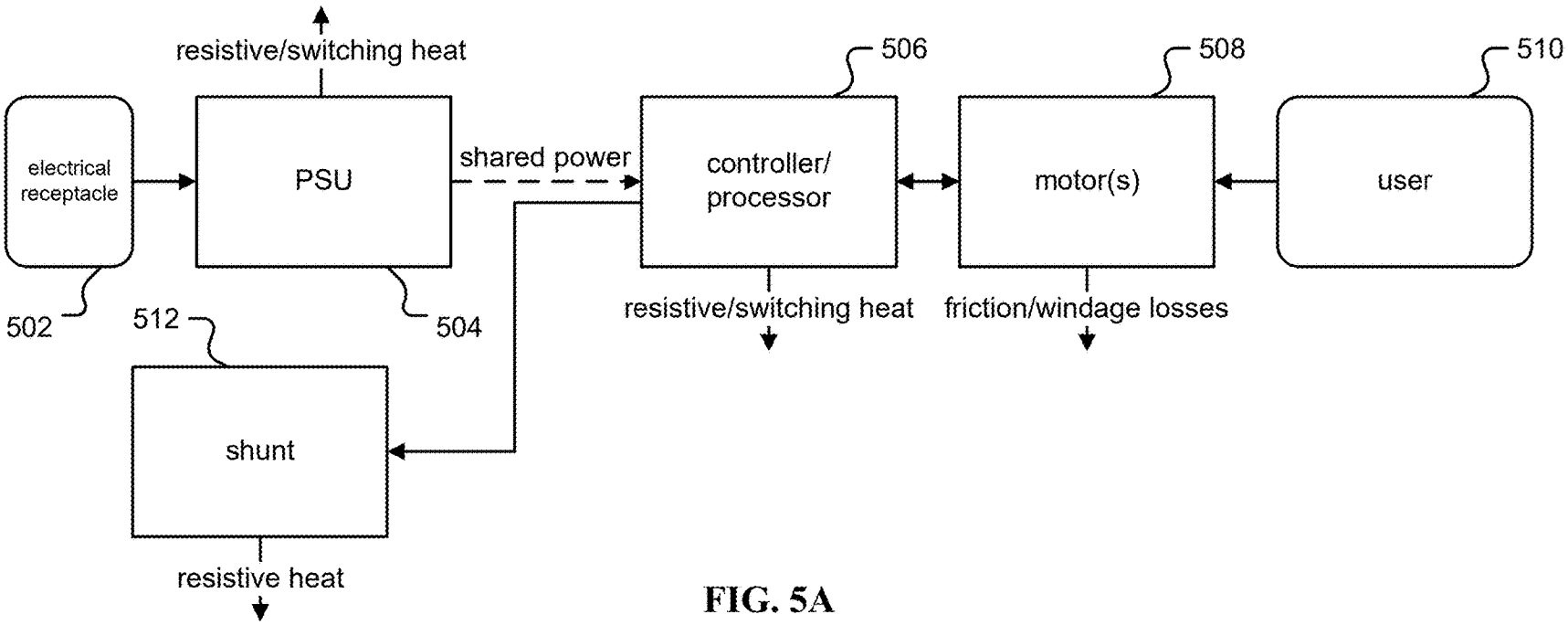
FIG. 5A is a diagram illustrating a concentric phase drivetrain energy flow.

FIG. 5A is a diagram illustrating a concentric phase drivetrain energy flow. In one embodiment, the controller/processor (506) of FIG. 5A is a block representing the controller (104) and/or processor (102) of FIG. 1A, housed in electronics bay (B720) of FIG. 1B. In one embodiment, the motor (508) of FIG. 5A is a block representing one or more motors (106) of FIG. 1A and/or motors (B100) of FIG. 1B. In one embodiment, the resistive shunt (512) of FIG. 5A is housed in electronics bay (B720) of FIG. 1B. The shared power mode of FIG. 5A is given as an example (412) in FIG. 4. The generator mode of FIG. 5A is given as an example (414) in FIG. 4.

In the concentric phase of a user exercise movement, the user is pulling on the actuator (110) in FIG. 1A, for example to start a bicep curl exercise movement when the user is pulling an actuator (110) upwards contracting the biceps, where the user input power, proportional to the user pull speed, is shared with the PSU input power. During the concentric phase the actuator (110) and cable (108) of FIG. 1A is being pulled out of the exercise device in what is referred to as an outward direction for actuator velocity and/or cable velocity.

At the start of a concentric phase in a user exercise movement, in shared power mode the electrical receptacle (502) provides energy to a PSU (504) with resistive/switching heat losses and outputs energy to the controller/processor (506). The controller/processor (506) provides energy to one or more motors (508) along with resistive/switching heat losses. The user (510) also provides energy to the one or more motors (508), and the motor(s) (508) have their own friction/windage losses due to the iron/copper in the motor.

The remaining energy is shunted to resistive shunt (512) where it is dissipated as resistive heat.

Next in the concentric phase in a user exercise movement, in the event the user input power is high enough that the PSU provides zero power, generator mode replaces the shared power mode. The dotted line of FIG. 5A is no longer part of the energy flow when the PSU (504) provides zero power. The user (510) provides all energy to one or more motors (508), which have their friction/windage losses and provide energy to controller/processor (506). The controller/processor (506) have their resistive/switching heat and net energy to the shunt (512) with its resistive heat dissipating all remaining energy.

As shown in FIG. 5A, concentric phase user exercise movements require the user (510) to provide power to the motor(s) (508). The exercise device is speed/velocity limited in the concentric phase by back EMF generated by the motor(s) (508) as compared with electronic component voltage ratings in the drivetrain, associated with the $K_e$ of the motors (508). The exercise device is power/torque limited in the concentric phase by phase current rating/heat rejection capacity on the inverter circuit(s) in the controller (506) and other drivetrain electronic components, and the shunt pulse power rating of the shunt (512). The exercise device is thermally limited by the motor(s) (508) cooling capacity which is related to the $K_t$ of the motors (508) in that a smaller $K_t$ results in higher phase current for a given torque and higher loss from $I^2R$ resistive losses. The exercise device is also thermally limited by the shunt (512) average power rating and cooling capability. The exercise device is also thermally limited by the weight requested by the user, which is proportional to the amount of torque requested from the motor, which increases the phase current and thus higher loss from $I^2R$ resistive losses.

Thus, the exercise device is constrained by the amount of power and speed the user (510) is inputting into the system shown in FIG. 5A. Power being generated by the user (510) may get absorbed by the motors (508) and controller/processor (506) before reaching the shunt (512) and/or being provided by the PSU (504). The distribution of power being shared is dependent on the motor torque and cable speed given the constant force system described above.

Figure 5B:
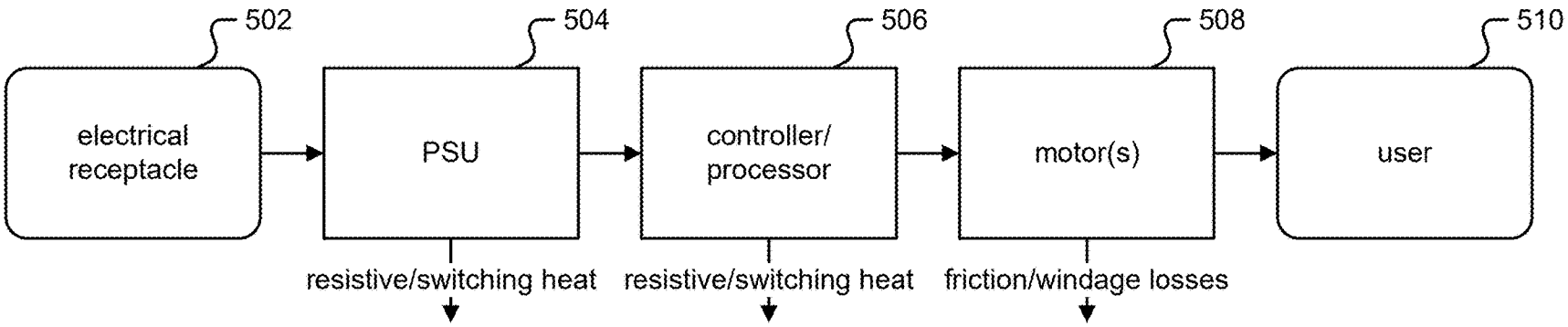
FIG. 5B is a diagram illustrating an eccentric phase drivetrain energy flow.

FIG. 5B is a diagram illustrating an eccentric phase drivetrain energy flow. In one embodiment, the controller/processor (506) of FIG. 5B is a block representing the controller (104) and/or processor (102) of FIG. 1A, housed in electronics bay (B720) of FIG. 1B. In one embodiment, the motor (508) of FIG. 5B is a block representing one or more motors (106) of FIG. 1A and/or motors (B100) of FIG. 1B. The motoring mode of FIG. 5B is given as an example (416) in FIG. 4.

In the eccentric phase of a user exercise movement, the electrical receptacle (502) is performing work on the user (510) holding onto the actuator (110) in FIG. 1A, for example to end a bicep curl exercise movement when the user is allowing the actuator (110) to return downwards, slightly relaxing the biceps in comparison to the concentric phase. During the eccentric phase the actuator (110) and cable (108) of FIG. 1A are being pulled back in to the exercise device in what is referred to as an inward direction for actuator velocity and/or cable velocity.

In the eccentric phase in a user exercise movement, the electrical receptacle (502) provides energy to a PSU (504) with resistive/switching heat losses and outputs energy to the controller/processor (506). The controller/processor (506) provides energy to one or more motors (508) along with resistive/switching heat losses. The one or more motors (508) perform work on the user (510), and the motor(s) (508) have their own friction/windage losses due to the iron/copper in the motor.

As shown in FIG. 5B, eccentric phase user exercise movements require power to be provided to the motors (508) from the power supply (504). The exercise device is power limited in the eccentric phase by the electrical receptacle rating, for example a typical residential outlet may provide 120V AC at 15 Amps with a UL derating of 20% providing 1,440 of watts of continuous power. The exercise device is also power limited in the eccentric phase by the PSU (504) ratings as the DC PSU (504) is rated for average power, and design/regulatory requirements for the controller/processor (506), motors (508) are higher in complexity for voltage over 60V DC, for example a 120 VAC to 48 VDC power supply may be used with its ratings and limits. Transient peak power requirements, average power requirements, and efficiency are the power supply (504) ratings and limits that affect power limiting in the eccentric phase.

The exercise device is speed/velocity limited in the eccentric phase by the $K_e$ of the motors (508) and the PSU (504) supply voltage, for example with 15% margin a maximum actuator/cable speed is $$\text{Maximum Speed} = 115\% \times V_{DC} \times K_e$$

The exercise device is thermally limited by the motor(s) (508) cooling capacity which is related to the $K_t$ of the motors (508) in that a smaller $K_t$ results in higher phase current for a given torque and higher loss from $I^2R$ resistive losses. The exercise device is also thermally limited by the weight requested by the user, which is proportional to the amount of torque requested from the motor, which increases the phase current and thus higher loss from $I^2R$ resistive losses.

Figure 6:
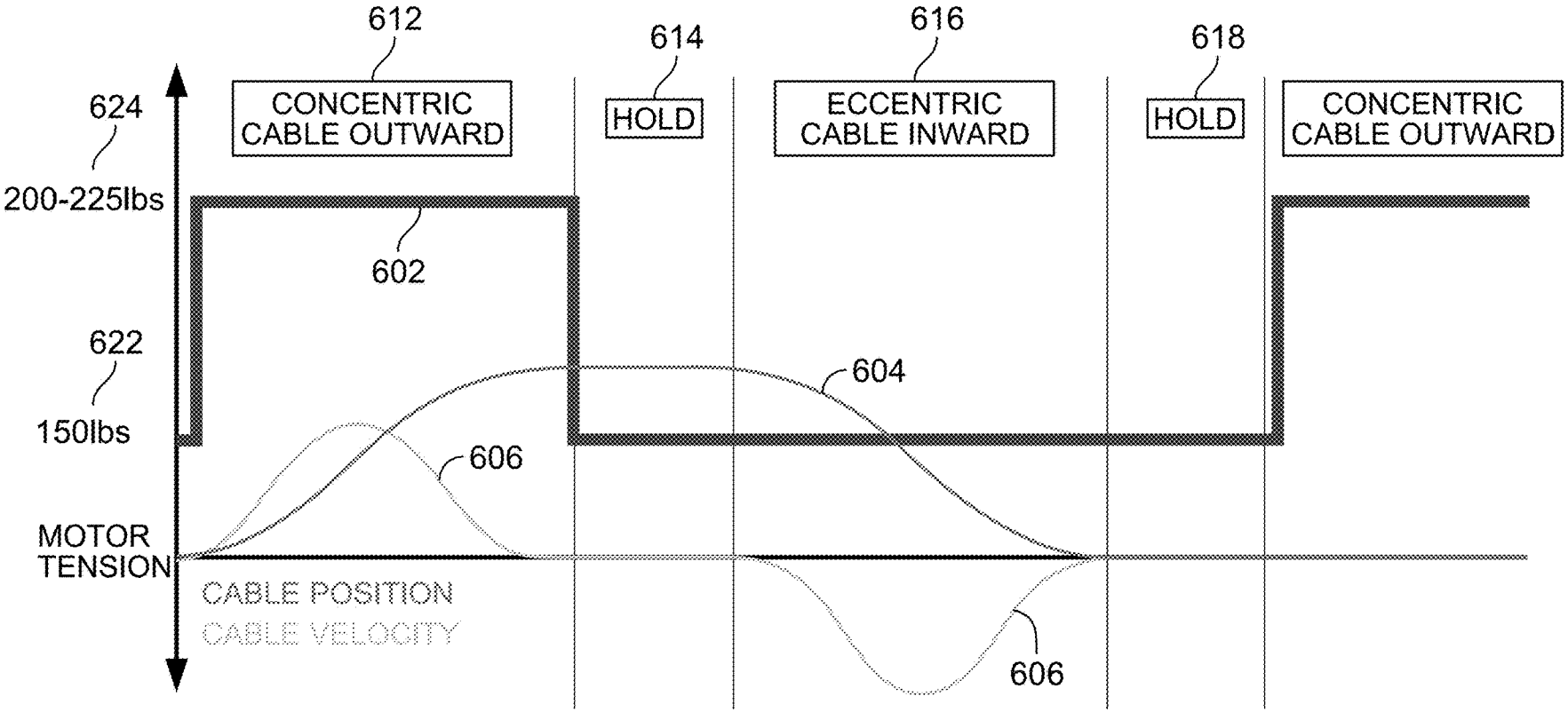
FIG. 6 is a diagram illustrating an example concentric boost mode for a digital exercise machine.

FIG. 6 is a diagram illustrating an example concentric boost mode for a digital exercise machine. In one embodiment, the system of FIGS. 1A and 1B is used to process the concentric boost mode of FIG. 6.

The graph shown in FIG. 6 has along the x-axis a timeline of an exercise movement and a partial subsequent exercise movement, along a primary y-axis motor tension (602), along a secondary y-axis cable speed/velocity (604), and along a tertiary y-axis cable position (606). As depicted in FIG. 6, a user exercise movement goes through at least four stages, a concentric phase (612) when the cable is being drawn outwards from the exercise machine as the user for example begins pulling a bicep curl upwards, a top hold phase (614) when the user for example holds the bicep curl at its apex, an eccentric phase (616) when the cable is being drawn inwards to the exercise machine as the user for example begins dropping the bicep curl downwards, and a bottom hold phase (618) when the user for example relaxes the bicep curl at its nadir.

As shown in FIG. 6, the concentric phase (612) may be identified by the system when the actuator velocity and/or cable velocity (606) is in an "outward direction", which as referred to herein is when the actuator velocity and/or cable velocity (606) is positive. A hysteresis curve may be established where the concentric phase (612) may be identified for an increased amount of torque requestable only after an actuator and/or cable velocity engagement threshold is reached, for example three inches per second. In one embodiment, the velocity engagement threshold is based on a saturation point, wherein the saturation point is based at least in part on a user requested weight, current drawn from a power supply coupled to the motor, a lower torque bound for requestable torque from the motor, a higher torque bound for requestable torque from the motor, and losses in the motor.

As shown in FIG. 6, the eccentric phase (616) may be identified by the system when the actuator velocity and/or cable velocity (606) is in an "inward direction", which as referred to herein is when the actuator velocity and/or cable velocity (606) is negative.

For the example system shown in FIG. 6, the power supply alone can provide at most 150 lbs of motor tension (622). Thus, a user doing a bicep curl exercise movement may specify to the exercise machine at most a "150 lb" set of bicep curls for a symmetric exercise movement, meaning at most "150 lb" of weight for the bicep curls in the concentric and eccentric phases.

A concentric boost mode is disclosed, wherein the user may specify to the exercise machine a "boost mode" referred to herein as an increased amount of torque requestable from the motor. Thus, a user doing a bicep curl exercise movement may specify to the exercise machine a "150 lb+Boost" set of bicep curls for an asymmetric exercise movement, meaning that during at least a portion of the user exercise movement in which the actuator velocity is in the outward direction and/or concentric phase, the user experiences a boosted increased weight, shown in FIG. 6 to be up to 200-225 lbs or around a 35% increase based on the drivetrain limits described above and in FIGS. 5A and 5B and the user's targets. The maximal boost weight is derived from a power balance where the boost force must be equal or less than $$F_{max} = \left(\frac{P_{supply} - P_{losses}}{V_{user}}\right)$$

After the concentric phase the eccentric bicep curl would return to 150 lb of weight experienced by the user. In summary, during the eccentric/inward phase, all power comes from the electrical receptacle, and during the concentric/outward phase, both the user and the electrical outlet are supplying power to the exercise device.

An improvement of concentric boost mode is that physiological studies have shown that increased strength and power output may be unlocked primarily in the concentric phase for a given user exercise movement such as bicep curl, bench press, and lat pulldown. Another improvement of concentric boost mode is that physiological studies have shown that increased concentric phase exercise and/or asymmetric exercise movements have increased hypertrophy and/or muscle growth potential. Another improvement of concentric boost mode is that physiological studies have shown that a user experiences reduced muscle damage and/or soreness when strain is shifted to concentric.

Exercise Device Inertia. Different digital exercise devices with different drivetrain designs have different resistance profiles, in part because the weight dynamics are different with for example a different number of motors and gearboxes. Using the processor (102) and/or controller (104) of FIG. 1A, allowing a first digital exercise device to emulate the resistance profile of a second digital exercise device is disclosed.

FIGS. 7A, 7B(1), and 7B(2) are diagrams illustrating an example of two different exercise devices with different drivetrain designs. FIG. 7A is a free body diagram of a one-motor exercise machine that has a single motor that drives two actuators via a differential gearbox, similar to that shown in FIGS. 1A, 1B, and 2. FIG. 7B(1) is a free body diagram of a two-motor exercise machine that has each of two motors drive one actuator without a differential gearbox, and wherein only one of the motors is shown in FIG. 7B(1).

In one embodiment, the two-motor exercise device comprises a singular motor which is spinning with a spool on it, and a user pulls directly against the motor via a cable and actuator, with frictional losses that happen as the cable goes across sheaves. With a smaller radius of the motor, a smaller mass that a user is spinning, so a smaller moment of inertia in comparison to the one-motor exercise device.

In one embodiment, the one-motor exercise device has a motor which is a bigger diameter motor and a heavier outer ring of magnet, with a larger moment of inertia. Note that moment of inertia tracks against a given mass as well as the geometry of a spinning object, so the motor itself has a higher moment of inertia. The one-motor exercise device also has a differential as a flywheel of steel that is spinning around in circles concentrically, adding another larger moment of inertia in comparison to the two-motor exercise device.

As a same or similar user is pulling on a cable for the two-motor exercise device versus the one-motor exercise device, the user pulling the one-motor exercise device has to accelerate both the differential and the bigger diameter motor up in comparison to the user pulling the two-motor exercise device with its smaller diameter motor. As Newton's Second Law of Motion describes that force equals mass times acceleration, the two devices have different mass or inertia for the device user's actuator. From the perspective of the motor, that mass/inertia may be described from the moment of inertia of each device's drivetrain. For example, an equivalent mass/inertia for a one-motor device may be between 23-25 lbs, whereas in one example, an equivalent mass/inertia for a two-motor device may be around 3 lbs.

It would be useful for a user of the two-motor device to provide a user experience of an equivalent 23-25 lb inertia exercise device for a larger weight requested during a user exercise movement, say for a request over 30 lb. It would be useful for a user of the one-motor device to provide a user experience of an equivalent 3 lb inertia exercise device for a smaller weight requested during a user exercise movement, say for a request under 30 lb.

One-Motor Free Body Diagram. Similar to that shown in FIGS. 1A, 1B, and 2, the one-motor exercise machine includes a motor (706), belt (710), differential (704), spools (702), and actuator cables (708). For the free body diagram of FIG. 7A, the following definitions are used:

| Variable | Definition | Units |
|---|---|---|
| $R_s$ | Radius of the Spool (702) | m |
| $R_d$ | Radius of the Differential Ring Gear (704) | m |
| $R_m$ | Radius of the Motor (706) | m |
| $\tau_m$ | Torque applied by the motor (706) | Nm |
| $T_1$ | Tension in either cable (708) | N |
| $T_2$ | Tension in the belt (710) | N |
| $\alpha_m$ | Motor (706) Angular Acceleration | $\frac{rad}{s^2}$ |
| $\alpha_{Ls}$ | Left Spool (702) Angular Acceleration | $\frac{rad}{s^2}$ |

-continued

| Variable | Definition | Units |
|---|---|---|
| $\alpha_{Rs}$ | Right Spool (702) Angular Acceleration | $\frac{rad}{s^2}$ |
| $\alpha_d$ | Differential Ring Gear (704) Angular Acceleration | $\frac{rad}{s^2}$ |
| $a_L$ | Left Cable (708) Linear Acceleration | $\frac{m}{s^2}$ |
| $a_R$ | Right Cable (708) Linear Acceleration | $\frac{m}{s^2}$ |
| g | Acceleration of gravity | $\frac{m}{s^2}$ |
| $I_m$ | Motor (706) Moment of Inertia | kg * $m^2$ |
| $I_d$ | Differential (704) Moment of Inertia | kg * $m^2$ |
| $m_1$ | Mass of hanging object | kg |
| $m_u$ | Equivalent point-mass of part of user's body | kg |
| $F_u$ | Force applied by user | N |

The following assumptions are made for a simplifying physics analysis:

A load applied to both arms is the same;

No friction analyzed;

100% efficient differential;

100% efficient belt drive; and

Frictionless bearings.

The motor rotating body equations to sum torques and solve for $T_2$:

$$\sum \tau = I_m \alpha_m$$

$$T_2 R_m - \tau_m = I_m \alpha_m$$

$$T_2 = \frac{I_m \alpha_m + \tau_m}{R_m} = \frac{I_m \alpha_m}{R_m} + \frac{\tau_m}{R_m}$$

When both cables are pulled, the differential is locked so that spool and differential angular velocity/acceleration are the same. The differential rotating body equations to sum torques and solve for $T_2$:

$$\sum \tau = I_d \alpha_d + I_s \alpha_{LS} + I_s \alpha_{RS}$$

$$\text{where } \alpha_{LS} = \frac{a_L}{R_s} \text{ and } \alpha_{RS} = \frac{a_R}{R_s}$$

$$\sum \tau = I_d \alpha_d + \frac{I_s a_L}{R_s} + \frac{I_s a_R}{R_s}$$

The differential applies the same torque to both spools.

$$2T_1 R_s - T_2 R_d = \sum \tau$$

$$2T_1 R_s - T_2 R_d = I_d \alpha_d + \frac{I_s a_L}{R_s} + \frac{I_s a_R}{R_s}$$

$$T_2 R_d = 2T_1 R_s - I_d \alpha_d - \frac{I_s a_L}{R_s} - \frac{I_s a_R}{R_s}$$

$$T_2 = \frac{2T_1 R_s}{R_d} - \frac{I_d \alpha_d}{R_d} - \frac{I_s (a_L + a_R)}{R_s R_d}$$

Equating the left and right cable acceleration to the differential spool angular acceleration:

$$\alpha_{LS} + \alpha_{RS} = \alpha_d$$

$$\frac{a_L + a_R}{R_s} = \alpha_d$$

And equating the differential and motor angular accelerations using the belt as the connecting element:

$$\alpha_d R_d = \alpha_m R_m$$

$$\alpha_d = \frac{R_m \alpha_m}{R_d}$$

Then equating the cable acceleration to the motor angular acceleration:

$$\frac{R_m \alpha_m}{R_d} = \alpha_d = \frac{a_L + a_R}{R_s}$$

$$R_s R_m \alpha_m = R_d (a_L + a_R)$$

$$\alpha_m = \frac{R_d (a_L + a_R)}{R_s R_m}$$

Equating the differential belt tension and motor belt tension:

$$T_2 = T_2$$

$$\frac{2T_1 R_s}{R_d} - \frac{I_d \alpha_d}{R_d} - \frac{I_s (a_L + a_R)}{R_s R_d} = \frac{I_m \alpha_m}{R_m} + \frac{\tau_m}{R_m}$$

Solving for the cable tension $T_1$:

$$\frac{2T_1 R_s}{R_d} = \frac{\tau_m}{R_m} + \frac{I_m \alpha_m}{R_m} + \frac{I_d \alpha_d}{R_d} + \frac{I_s (a_L + a_R)}{R_s R_d}$$

$$T_1 = \frac{\tau_m R_d}{2R_s R_m} + \frac{I_m \alpha_m R_d}{2R_s R_m} + \frac{I_d \alpha_d}{2R_s} + \frac{I_s (a_L + a_R)}{2R_s^2}$$

Substituting in the $a_m$ derived above:

$$\alpha_m = \frac{R_d (a_L + a_R)}{R_s R_m}$$

$$T_1 = \frac{\tau_m R_d}{2R_s R_m} + \frac{I_m R_d^2 (a_L + a_R)}{2R_s^2 R_m^2} + \frac{I_d \alpha_d}{2R_s} + \frac{I_s (a_L + a_R)}{2R_s^2}$$

Substituting in the $a_d$ derived above:

$$\alpha_d = \frac{a_L + a_R}{R_s} \qquad \text{(Equation EQ1)}$$

$$T_1 = \frac{\tau_m R_d}{2R_s R_m} + \frac{I_m R_d^2 (a_L + a_R)}{2R_s^2 R_m^2} + \frac{I_d (a_L + a_R)}{2R_s^2} + \frac{I_s (a_L + a_R)}{2R_s^2}$$

Solving in terms of motor acceleration:

$$\alpha_m = \frac{R_d (a_L + a_R)}{R_s R_m}$$

-continued $$(a_L + a_R) = \frac{\alpha_m R_s R_m}{R_d}$$

Substituting the left and right cable accelerations for motor angular acceleration to only use motor parameters:

$$T_1 = \frac{\tau_m R_d}{2R_s R_m} + \frac{I_m \alpha_m R_d}{2R_s R_m} + \frac{I_d \alpha_m R_m}{2R_s R_d} + \frac{I_s \alpha_m R_m}{2R_s R_d} \quad \text{(Equation EQ2)}$$

Two-Motor Free Body Diagram. The two-motor exercise machine includes a motor (752) and actuator cables (754). For the free body diagram of FIG. 7B(1), the following definitions are used:

| Variable | Definition | Units |
|---|---|---|
| $R_m$ | Radius of the motor (752) | m |
| $\tau_m$ | Torque applied by the motor (752) | N * m |
| $T_1$ | Tension in the cable (754) | N |
| $m_1$ | Mass of hanging object | kg |
| $I_m$ | Motor (752) Moment of Inertia | kg * $m^2$ |
| $\alpha_m$ | Motor (752) Angular Acceleration | $\frac{rad}{s^2}$ |
| a | Cable (754) acceleration | $\frac{m}{s^2}$ |
| g | Acceleration of gravity | $\frac{m}{s^2}$ |
| $m_u$ | Equivalent point-mass of part of user's body | kg |
| $F_u$ | Force applied by user | N |

The following assumptions are made for a simplifying physics analysis:

No windage;

Dynamic friction only, lumping effects of the sheaves/cable bending together; and Ignore the moment of inertia of other sheaves in the system.

The motor rotating body equations to solve for $T_1$ when the motor torque directly opposes the user force applied at the cable (754):

$$T_1 R_m - \tau_m = I_m \alpha_m$$

$$T_1 = \frac{\tau_m}{R_m} + \frac{I_m \alpha_m}{R_m}$$

Equating the cable acceleration to the differential angular acceleration:

$$a = R_m \alpha_m$$

$$\alpha_m = \frac{a}{R_m}$$

And substituting motor angular acceleration into the tension equation:

$$T_1 = \frac{\tau_m}{R_m} + \frac{I_m a}{R_m^2}$$

Resistance Profile Emulation. As shown in FIG. 7A and FIG. 7B(1), the drivetrain of a two-motor system, termed herein an "E" system, is simpler than the drivetrain of a one-motor system, termed herein a "C" system. An "E" system may mimic the user experience and/or an experienced inertia when a user exceeds a certain requested weight, say 30 lbs. That is, a user may enjoy the lower weight dynamics of a simpler "E" system for requested weights less than e.g. 30 lb but also enjoy the challenge of a "C" system at requested weights more than e.g. 30 lb.

To provide the physical analysis for this emulation, the equation of motion derived above for the "C" one-motor system and the equation of motion for the "E" two-motor system are solved for a phantom moment of inertia to be added to the "E" system:

Starting with the "C" system cable tension, using the "c" subscript for the "C" system:

$$T_1 = \frac{\tau_{mc} R_d}{2R_s R_m} + \frac{I_{mc} R_d^2 (a_L + a_R)}{2R_s^2 R_m^2} + \frac{I_d (a_L + a_R)}{2R_s^2} + \frac{I_s (a_L + a_R)}{2R_s^2}$$

Comparing the "E" system with two motors, each motor is in control of a single side, so one side may be dropped from the "C" system acceleration:

$$T_1 = \frac{\tau_{mc} R_d}{2R_s R_m} + \frac{I_{mc} R_d^2 a}{2R_s^2 R_m^2} + \frac{I_d a}{2R_s^2} + \frac{I_s a}{2R_s^2}$$

The "E" system cable tension, using the "e" subscript for the "E" system:

$$T_1 = \frac{\tau_{me}}{R_{me}} + \frac{I_{me} a}{R_{me}^2}$$

To make an "E" system feel like a "C" system comprises having the same force response to applied accelerations. This may be accomplished by adding a new term to the "E" system's tension:

$$T_1 = \frac{\tau_{me}}{R_{me}} + \frac{I_{me} a}{R_{me}^2} + \frac{Xa}{R_{me}^2}$$

Setting the cable tensions so they equal and solving for the extra moment of inertia to reach equilibrium:

$$\frac{\tau_{me}}{R_{me}} + \frac{I_{me} a}{R_{me}^2} + \frac{Xa}{R_{me}^2} = \frac{\tau_{mc} R_d}{2R_s R_m} + \frac{I_{mc} R_d^2 a}{2R_s^2 R_m^2} + \frac{I_d a}{2R_s^2} + \frac{I_s a}{2R_s^2}$$

Equalizing the motor torques as these are the weight dial portions:

$$\frac{I_{me} a_L}{R_{me}^2} + \frac{X a_L}{R_{me}^2} = \frac{I_{mc} R_d^2 a_L}{2R_s^2 R_m^2} + \frac{I_d a_L}{2R_s^2} + \frac{I_s a_L}{2R_s^2}$$

Solving for "X" provides the additional moment of inertia to be multiplied by the angular acceleration to feel the same as the "C" system:

$$X = \left(\frac{I_{mc}R_d^2}{2R_s^2R_m^2} + \frac{I_d}{2R_s^2} + \frac{I_s}{2R_s^2}\right)R_{me}^2 - I_{me}$$

Thus, when an "C" system emulation mode is enabled, for example for a requested weight for a user exercise movement exceeds a threshold amount, then the torque controller (104) of FIG. 1A adjust torque that is requested of the motor (106) to generate an experienced inertia by adding X multiplied by the angular acceleration to the mechanical inertia of the actuator related to the moment of inertia Ime of the "E" system.

Slack Control. The above Equation (EQ1) describes, for a user pulling on a cable, how motor torque applied is related to acceleration of the motor, spools, cables, and differential. Note that in Equation (EQ1) that the terms of $R_d$, $R_s$, $R_m$, $I_m$, $I_d$, and $I_s$ are constants in the sense that they are fixed parameters once the drivetrain is designed and implemented for a given exercise device.

For example, if the actuator is not moving, the actuator and cable acceleration components of Equation (EQ1), $a_L$ and $a_R$ are zero, simplifying the relationship between cable tension and motor torque as a function of radius/sizes of the motor, differential, and spool:

$$T_1 = \frac{\tau_m R_d}{2R_sR_m}$$

when $a_L$ and $a_R$ are zero.
wherein the relationship may be thought of as $T_1$ equal to a constant multiplied by $\tau_m$.

Issues may arise when the cable comes loose inside an exercise machine due to gravity acting in a different direction than the spooling and tension force. This gravity direction may depend on the mounting of the motor, whether mounted vertically, horizontally, or at an angle between vertically and horizontally.

For example, suppose that when the user is performing an exercise, the user accelerates when in the eccentric direction where the cable is retracting. In this case, the user is moving inwards faster than the motor can take up the slack in the cable, generating what is referred to herein as a slack condition, or slack, in the direction towards the machine.

Similarly, when the user is pulling outwards on the cable and suddenly stops, this may result in an inertial issue in which a slack condition is produced. The inertia of the motor causes the motor to continue to travel before torque regeneration may stop the motor and allow it to reverse. During that time frame, a slack condition is created, where there is no tension on the cable, as the motor's inertia is greater than the torque that the motor is producing. Thus, the above two slack conditions are dependent on the maximum linear speed that may be imparted on the motor, as well as the inertia of the motor. Slack conditions may cause a cable to no longer be inline with the spool/motor, in which case the cable may then potentially become bound, jammed, and/or tangled. For example, when the cable slacks and the motor takes up the cable in a random fashion, this may cause a large knot to form around the motor's axle.

The above Equation (EQ1) also describes, when no user force is applied in the system when $T_1$ is zero, how acceleration of the system is related to a given motor torque. When slack occurs, there is no user force being applied in the system as the cable is loose, so Equation (EQ1) better identifies when slack conditions occur in order to change behaviors/system dynamics, allowing the improvement to react to slack conditions faster:

$$\frac{\tau_m R_d}{2R_sR_m} + \frac{I_mR_d^2(a_L + a_R)}{2R_s^2R_m^2} + \frac{I_d(a_L + a_R)}{2R_s^2} + \frac{I_s(a_L + a_R)}{2R_s^2} = 0$$

during a slack condition.

In one embodiment, $T_1$ is not directly measured in an exercise device for an improvement in power reduction, materials reduction, and cost reduction, but motor position measurement is available. In one embodiment, the cable tension is derived from the estimated motor torque, the system geometry and the moment of inertia. Due to the mechanical linkage between motor position and cables, the motor position correlates $a_L$ and $a_R$ to determine the linear acceleration of either cable. The motor position measurement may thus be used in conjunction with the radius of drivetrain components and the moment of inertia of drivetrain components to determine an estimate of motor torque provided. Note again that for the motor, $\tau_m$ is equal to $K_t$ multiplied by I, wherein $K_t$ is the torque constant of the motor and I is the motor's phase current, which can be driven by the exercise device, for example by supplying 32 amps worth of phase current to provide a requested weight of 50 lbs for a given user exercise movement. Continuing with slack control, if a user stops pulling, then $\tau_m$ is equal to a constant multiplied by $(a_L+a_R)$. Using the motor position measurement to determine $a_L$ and $a_R$ the estimated motor torque may be determined using this equation to predict how the system decelerates during the potential slack condition, or put another more direct way in terms of motor phase current in a potential slack condition, for example:

$$I = \frac{-2R_sR_m}{R_dK_t}\left(\frac{I_mR_d^2}{2R_s^2R_m^2} + \frac{I_d}{2R_s^2} + \frac{I_s}{2R_s^2}\right)(a_L + a_R)$$

Outward Slack Control. During an example outward slack condition, the user is pulling outwards on the cable and suddenly stops, for example a user is doing a bicep curl exercise movement in the concentric phase and comes to a complete halt. To reduce the inertial issue where the inertia of the motor causes the motor to continue to travel producing slack, the motor position is used in part to identify the slack condition. Once an outward slack condition is identified, the exercise device increases the requested torque to bring the rotating mass to a near stop to reduce cable slack. In one embodiment, the outward slack condition monitoring vigilance is enhanced by detecting using motor position when a user is beginning and ending a concentric phase of a user exercise movement and allocating more resources to outward slack condition monitoring when a concentric phase is detected.

Inward Slack Control. During an example inward slack condition, the user accelerates the actuator in the eccentric phase wherein the cable is retracting, for example a user is doing a bicep curl exercise movement in the eccentric phase and either drops their actuator completely down suddenly, or lets go of the actuator. To reduce the inertial issue where the user is moving inwards faster than the motor can take up the slack in the cable, the relationship described in Equation (EQ1) is used to identify the slack condition wherein $T_1$ is zero. That is, the processor observes $a_L$ and $a_R$ as large as possible given the amount of motor torque provided, meaning the user is likely not imposing any tension.

Once a slack condition is identified, the exercise device begins matching the cable acceleration by changing the motor phase current to affect the motor torque per the relationship described in Equation (EQ1), in part to consume any cable slack to a point where $T_1$ is larger than zero. In one embodiment, the inward slack condition monitoring vigilance is enhanced by detecting using motor position when a user is beginning and ending an eccentric phase of a user exercise movement and allocating more resources to inward slack condition monitoring when an eccentric phase is detected.

Figure 8:
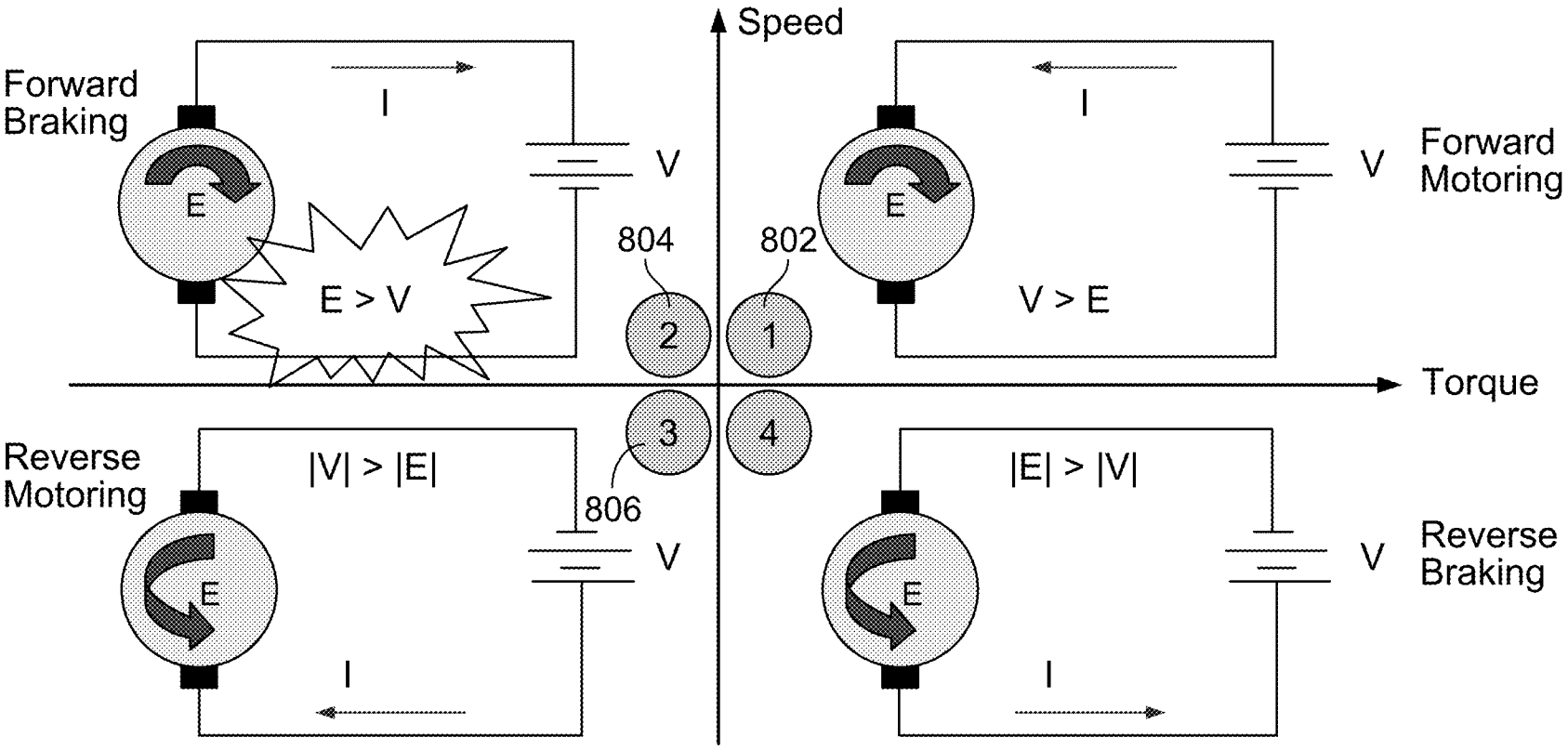
FIG. 8 is a diagram illustrating the traditional four modes of a motor.

FIG. 8 is a diagram illustrating the traditional four modes of a motor. In one embodiment, the motor (106) of FIG. 1A or the motor (B100) of FIG. 1B is similar to the motor shown in FIG. 8.

As shown in FIG. 8, a quadrant of forward motion and reverse motion crossed with motoring and braking/generation is due to the electromagnetic field of the motor. Adopting the convention that forward motion is outward motion and reverse motion is inward motion, for the exercise device described herein, the motor (106) of FIG. 1A or the motor (B100) of FIG. 1B in the concentric phase engages the user in quadrant 1 forward motoring (802) during the shared power mode, and then possibly quadrant 2 forward generation/braking (804) during the generator mode. In the eccentric phase, the motor engages the user in quadrant 3 reverse motoring (806) during the motoring mode. Thus outwards slack conditions are generally when the motor (106)/(B100) is in quadrant 2 forward generation/braking/resisting (804), and inward slack conditions are generally when the motor (106)/(B100) is in quadrant 3 reverse motoring (806). Thus, torque for both outward slack conditions and inward slack conditions are applied in the same direction, wherein when motor phase current I is increased it increase braking in an outward slack condition, and wherein when motor phase current I is increased, it increases motoring/acceleration in an inward slack condition.

Experienced Inertia different from Mechanical Inertia. Starting with quadrant 1 forward motoring (802) during the shared power mode of a concentric phase within a user exercise movement, without compensation the user pulling the actuator experiences an inertia which is referred to herein as the mechanical inertia of the actuator. For a user of a "C" one-motor exercise device, the user experience may be improved if they experience a different experienced inertia, referred to herein as the effective inertia experienced by a user pulling the actuator. For example the experienced inertia of a "C" one-motor exercise device may be, for lower requested weights for a user exercise movement, the mechanical inertia of an "E" two-motor exercise device. For example, for lower requested weights, if a "C" machine has larger drivetrain inertia, it is hard to do lower weight exercise movements like shoulder rotator cuff type exercises, especially for weaker individuals. Allowing weaker or injured individual to do training and/or exercise to in part strengthen or heal injuries is an improvement. Dynamically changing the experienced inertia apart from the mechanical inertia of the actuator is disclosed.

Returning to Equation (EQ1), if $T_1$ is small and less than a threshold, say 3 lb which is less than a threshold of 30 lb, the exercise device asserts phase current to the motor (106)/(B100) to adapt $\tau_m$ based on what the cable acceleration values $a_L$ and $a_R$ are, effectively executing a control loop on $\tau_m$. This may be simplified further given that cable acceleration values $a_L$ and $a_R$ are derived from a motor position encoder, to instead use Equation (EQ2) relating $T_1$, $\tau_m$, and $a_m$, the angular acceleration of the motor which may be estimated as a second derivative of angular position of the motor with respects to time. Asserting phase current to the motor (106)/(B100) and/or adjusting motor torque to execute a control loop on $\tau_m$ based on what the motor acceleration $\alpha_m$ for a given requested $T_1$ is disclosed. This control loop may be asserted in all three quadrants of FIG. 8, including the shared power mode, generator mode, and/or motoring mode in concentric phase and eccentric phase of a user exercise movement.

Note that a converse case may also use the improvement of experienced inertia. For example, for a user of an "E" two-motor exercise device, the user experience may be improved if they experience a different experienced inertia, such as that of the mechanical inertia of a "C" one-motor exercise device for higher requested weights for a user exercise movement. For example, for higher requested weights, if an "E" machine has smaller inertia, higher weight exercise movements like dead lift type exercises seem different from the same exercises performed with an actual physical barbell. Allowing users to do training and/or exercise to better emulate actual physical exercise is an improvement. Dynamically changing the experienced inertia apart from the mechanical inertia of the actuator is disclosed.

Figure 9:
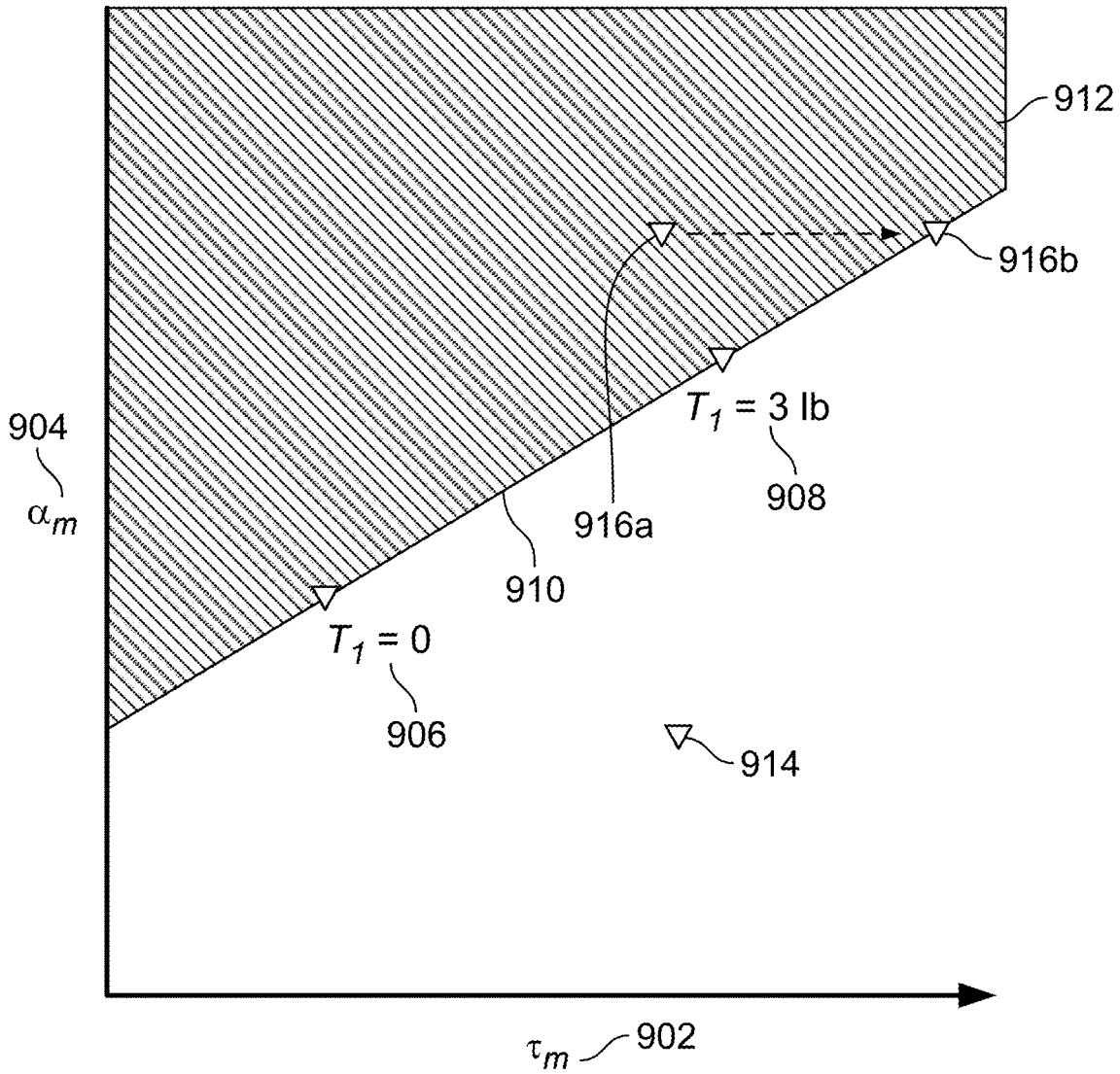
FIG. 9 is a graphical illustration of a control loop for inwards slack control.

Motor Control Loop for Inwards Slack Control. FIG. 9 is a graphical illustration of a control loop for inwards slack control. The analysis of FIG. 9 is based on Equation (EQ1) and/or Equation (EQ2). Conceptually a graph is established in the controller (104) of FIG. 1A, wherein the x-axis represents motor torque $\tau_m$ (902) and the y-axis represents motor angular acceleration $a_m$ (904), so that several points may be empirically recorded during a calibration sequence, for example for a fixed motor torque with zero cable tension, the acceleration value is recorded at point (906). Similarly for a fixed motor torque with a cable tension of 31 lb, the acceleration value is recorded at point (908). After several recorded points a sloped line with y-intercept is established (910). The area (912) above the sloped line (910) is considered an inwards slack condition.

Thus during a user exercise movement, especially in the eccentric phase, in the event a recorded acceleration and torque pair (914) is below the line (910), the control loop interprets this as a user contributing power towards the system and no slack condition is detected. However, in the event a recorded acceleration and torque pair (916*a*) is above the line (910), the control loop interprets this as an inward slack condition and increases motor torque via motor phase current to bring the system to a point at or below the line (916*b*), thus "catching up" with the hyperaccelerated cable and reducing cable slack. The line (910) may thus be thought of as a "free fall" line (910) describing maximal cable acceleration achievable with a fixed motor torque.

In one embodiment, the tension on cable $T_1$ is measured directly in the exercise device via for example an inline load cell. For inward slack control, in the event the tension on cable $T_1$ is measured to be zero at an unexpected point in the eccentric phase, the control loop interprets this as an inward slack condition and increases motor torque via motor phase current to bring the system to a point at or below the free fall line (910).

Torque Controller Technique. During at least a portion of a user exercise movement in which an actuator velocity of an actuator is in an outward direction, an amount of torque that is requestable from a motor is increased based at least in part on the actuator velocity, wherein the motor provides resistance to the actuator; and wherein the actuator is coupled to the motor.

In one embodiment, the actuator velocity is determined. In one embodiment, the outward direction comprises a user concentric direction. In one embodiment, the outward direction comprises any direction that a user ultimately supplies power to the exercise device.

In one embodiment, the increased amount of torque requestable from the motor is based at least in part on a determination whether the actuator velocity is greater than a velocity engagement threshold. In one embodiment, the velocity engagement threshold is based at least on a saturation point. In one embodiment, the saturation point is based at least in part on a current user requested weight, current drawn from a power supply coupled to the motor, a lower torque bound for requestable torque from the motor, a higher torque bound for requestable torque from the motor, and losses in the motor.

In one embodiment, the increased amount of torque requestable from the motor is based at least in part on a current motor temperature. In one embodiment, the increased amount of torque requestable from the motor is based at least in part on a torque constant or a back EMF constant for the motor. In one embodiment, the increased amount of torque requestable from the motor is based at least in part on a number of motor windings for the motor. In one embodiment, the increased amount of torque requestable from the motor is based at least in part on speed limitations of a drivetrain comprising the motor.

In one embodiment, the increased amount of torque requestable from the motor is based at least in part on power limitations of a drivetrain comprising the motor. In one embodiment, the increased amount of torque requestable from the motor is based at least in part on thermal limitations of a drivetrain comprising the motor.

Although the foregoing embodiments have been described in some detail for purposes of clarity of understanding, the invention is not limited to the details provided. There are many alternative ways of implementing the invention. The disclosed embodiments are illustrative and not restrictive.

What is claimed is:

1. An exercise device comprising:

a motor that provides resistance to an actuator coupled to the motor; and a torque controller configured to:

during at least a portion of a user exercise movement in which an actuator velocity is in an outward direction, increase an amount of torque that is requestable from the motor based at least in part on the actuator velocity.

2. The exercise device of claim 1, further comprising a processor configured to determine the actuator velocity.

3. The exercise device of claim 1, wherein the outward direction comprises any direction that a user ultimately supplies power to the exercise device.

4. The exercise device of claim 1, wherein the increased amount of torque requestable from the motor is based at least in part on a determination whether the actuator velocity is greater than a velocity engagement threshold.

5. The exercise device of claim 4, wherein the velocity engagement threshold is based at least on a saturation point.

6. The exercise device of claim 5, wherein the saturation point is based at least in part on a current user requested weight, current drawn from a power supply coupled to the motor, a lower torque bound for requestable torque from the motor, a higher torque bound for requestable torque from the motor, and losses in the motor.

7. The exercise device of claim 1, wherein the increased amount of torque requestable from the motor is based at least in part on a current motor temperature.

8. The exercise device of claim 1, wherein the increased amount of torque requestable from the motor is based at least in part on a torque constant or a back EMF constant for the motor.

9. The exercise device of claim 1, wherein the increased amount of torque requestable from the motor is based at least in part on a number of motor windings for the motor.

10. The exercise device of claim 1, wherein the increased amount of torque requestable from the motor is based at least in part on speed limitations of a drivetrain comprising the motor.

11. The exercise device of claim 1, wherein the increased amount of torque requestable from the motor is based at least in part on power limitations of a drivetrain comprising the motor.

12. The exercise device of claim 1, wherein the increased amount of torque requestable from the motor is based at least in part on thermal limitations of a drivetrain comprising the motor.

13. A method, comprising:

during at least a portion of a user exercise movement in which an actuator velocity of an actuator is in an outward direction, increasing an amount of torque that is requestable from a motor based at least in part on the actuator velocity;

wherein the motor provides resistance to the actuator; and wherein the actuator is coupled to the motor.

* * * * *